US009347278B2

(12) United States Patent
Stautzenberger et al.

(10) Patent No.: US 9,347,278 B2
(45) Date of Patent: May 24, 2016

(54) LOAD CROSS-OVER SLIP-JOINT MECHANISM AND METHOD OF USE

(71) Applicant: HALLIBURTON ENERGY SERVICES, INC., Houston, TX (US)

(72) Inventors: Arthur Stautzenberger, Denton, TX (US); Brock Watson, Oklahoma City, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 370 days.

(21) Appl. No.: 13/997,816

(22) PCT Filed: Oct. 1, 2012

(86) PCT No.: PCT/US2012/058242

§ 371 (c)(1),
(2) Date: Jun. 25, 2013

(87) PCT Pub. No.: WO2014/055060

PCT Pub. Date: Apr. 10, 2014

(65) Prior Publication Data

US 2015/0315849 A1 Nov. 5, 2015

(51) Int. Cl.

| | |
|---|---|
| ***E21B 17/04*** | (2006.01) |
| ***E21B 43/10*** | (2006.01) |
| *E21B 23/00* | (2006.01) |
| *E21B 17/06* | (2006.01) |

(52) U.S. Cl.

CPC ..... *E21B 17/04* (2013.01); *E21B 43/105* (2013.01); *E21B 17/06* (2013.01); *E21B 23/00* (2013.01)

(58) Field of Classification Search

CPC ..... E21B 17/04; E21B 17/042; E21B 43/105; E21B 17/06; E21B 23/00

See application file for complete search history.

(56) References Cited

U.S. PATENT DOCUMENTS

| | | | | |
|---|---|---|---|---|
| 4,253,521 | A | 3/1981 | Savage | |
| 5,046,557 | A * | 9/1991 | Manderscheid | E21B 33/1295 166/120 |
| 6,997,252 | B2 | 2/2006 | Porter et al. | |
| 7,487,832 | B2 * | 2/2009 | Read, Jr. | E21B 17/06 166/123 |
| 8,100,188 | B2 * | 1/2012 | Watson | E21B 43/105 166/208 |

(Continued)

OTHER PUBLICATIONS

Written Opinion dated Apr. 10, 2013 for PCT Application No. PCT/US2012/058242.

(Continued)

*Primary Examiner* — Nicole Coy
(74) *Attorney, Agent, or Firm* — Haynes and Boone LLP

(57) ABSTRACT

A downhole tool assembly is presented for use in a wellbore, the tool having a mandrel assembly for substantially bearing the tensile and rotational loads placed on the tool assembly during run-in to the wellbore, a displacement assembly for substantially bearing displacement loads and for providing relative movement to the mandrel assembly, the displacement assembly for actuating a actuable tool attached to the mandrel assembly. The mandrel assembly has an upper mandrel positioned radially outward of the displacement assembly and a lower mandrel positioned radially inward of the displacement assembly. A load cross-over mandrel transfers the tensile and rotational loads between the upper and lower mandrels. The load cross-over mandrel has a plurality of passages which allow corresponding rods of the displacement assembly to slide therethrough. The rods transfer the displacement loads from actuators above the rods to an actuable tool below the rods.

17 Claims, 21 Drawing Sheets

(56) References Cited

U.S. PATENT DOCUMENTS

| | | | | |
|---|---|---|---|---|
| 8,261,842 | B2 * | 9/2012 | Moeller | E21B 43/105 166/207 |
| 8,371,388 | B2 * | 2/2013 | Moeller | E21B 43/105 166/207 |
| 8,393,389 | B2 * | 3/2013 | Brisco | E21B 34/14 166/208 |
| 8,443,905 | B2 * | 5/2013 | Moeller | E21B 43/106 166/242.6 |
| 8,448,712 | B2 * | 5/2013 | Moeller | E21B 43/106 166/242.6 |
| 8,627,884 | B2 * | 1/2014 | Watson | E21B 43/105 166/208 |
| 2005/0006106 | A1 | 1/2005 | Hirth et al. | |
| 2005/0224226 | A1 | 10/2005 | Read, Jr. | |
| 2008/0277111 | A1 | 11/2008 | Braddick | |
| 2009/0314496 | A1 | 12/2009 | Begnaud et al. | |
| 2010/0252252 | A1 | 10/2010 | Harris et al. | |
| 2011/0132622 | A1 | 6/2011 | Moeller et al. | |

OTHER PUBLICATIONS

International Search Report dated Apr. 10, 2013 for PCT Application No. PCT/US2012/058242.

Search Report and First Written Opinion issued by the Intellectual Property Office of Singapore, regarding Singapore patent application No. 11201502485V, dated Jan. 12, 7 pages.

* cited by examiner

LOAD CROSS-OVER SLIP-JOINT MECHANISM AND METHOD OF USE

CROSS-REFERENCE TO RELATED APPLICATIONS

None.

FIELD OF INVENTION

Methods and apparatus are presented for transfer of tensile and rotational loads on a tool assembly from an external sleeve mandrel to an inner mandrel. The arrangement allows easier make-up of lengthy tool assemblies on a rig or derrick floor since the external load-bearing sleeve allows for a normal tool-joint for assembly and disassembly. The upper external mandrel sleeve and lower internal mandrel sleeve are connected by a load cross-over joint which allows relative movement of a displacement or setting assembly.

BACKGROUND OF INVENTION

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs).

In order to produce hydrocarbons, a wellbore is drilled through a hydrocarbon-bearing zone in a reservoir. In a cased-hole wellbore or portion thereof, a casing is placed, and typically cemented, into the wellbore providing a tubular wall between the zone and the interior of the cased wellbore. A tubing string can then be run in and out of the casing. Similarly, tubing string can be run in an uncased wellbore or section of wellbore. As used herein, "tubing string" refers to a series of connected pipe sections, joints, screens, blanks, cross-over tools, downhole tools and the like, inserted into a wellbore, whether used for drilling, work-over, production, injection, completion, or other processes. Further, in many cases a tool can be run on a wireline or coiled tubing instead of a tubing string, as those of skill in the art will recognize. A wellbore can be or include vertical, deviated, and horizontal portions, and can be straight, curved, or branched.

During completion of an open-hole wellbore portion, a completion tubing string is placed into the wellbore. The tubing string allows fluids to be introduced into, or flowed from, a remote portion of the wellbore. A tubing string is created by joining multiple sections of pipe together, typically via male right-handed threads at the bottom of an upper section of pipe and corresponding female threads at the top of a lower section of pipe. The two sections of pipe are connected to each other by applying a right-hand torque to the upper section of pipe while the lower section of pipe remains relatively stationary. The joined sections of pipe are then lowered into the wellbore. The process is referred to as "making up" a string. The tools used in the string are often assembled, or made-up, on the rig floor. In fact, this may be required for lengthy tools inserted by a standard rig.

It is typical in hydrocarbon wells to "set" or actuate a downhole tool, such as expansion tools, packers, bridge plugs, gauge hangers, straddles, wellhead plugs, cement retainers, through-tubing plugs, etc. Setting of tools is often done in conjunction with other wellbore operations. For example, a tubing string is run into a wellbore to hang an expandable liner, cement around the liner, and then expand the liner. The string is then disconnected from the installed liner and hanger and retrieved to the surface.

In a typical liner hanger tool string, the tensile load and rotational load on the string is carried through an internal mandrel. The relative motion required for setting the tool, and the transfer of setting loads, is typically done using a non-load bearing external cylinder or sleeve. For example, commercially available from Halliburton Energy Services, Inc., is a Versaflex (trade name) running tool having such a configuration. If the tools are made-up, such as in two halves, on the rig floor, this arrangement is cumbersome, requiring make-up of the mandrel assembly and make-up of the external cylinder assembly, including seals. For most applications, the use of the assembled parts with seals also requires a pressure test prior to use. Such tests can be awkward, time-consuming or even impossible on the rig floor.

Consequently, there is a need for an improved manner of design, assembly and use of running tools.

SUMMARY OF THE INVENTION

A downhole tool assembly is presented for use in a wellbore, the tool having a mandrel assembly for substantially bearing the tensile and rotational loads placed on the tool assembly during run-in to the wellbore, a displacement assembly for substantially bearing displacement loads and for providing relative movement to the mandrel assembly, the displacement assembly for actuating a actuatable tool attached to the mandrel assembly. The mandrel assembly has an upper mandrel positioned radially outward of the displacement assembly and a lower mandrel positioned radially inward of the displacement assembly. A load cross-over mandrel transfers the tensile and rotational loads between the upper and lower mandrels. The load cross-over mandrel has a plurality of passages which allow corresponding rods of the displacement assembly to slide therethrough. The rods transfer the displacement loads from actuators above the rods to an actuable tool below the rods.

For example, an expandable liner hanger and cementing tool is run into a wellbore. After cementing operations, the expandable liner hanger is expanded using a cone or the like. The expansion is powered by hydraulic pressure-up in the tool string which operates piston assemblies of the displacement assembly. The movement of the pistons causes movement of a set of displacement load rods which extend through passages in a laterally extending portion of the mandrel assembly. The mandrel assembly bears the tensile and torsional loads and has an upper mandrel positioned radially outward of the displacement assembly, a lower mandrel positioned radially inward of the displacement assembly, and a load cross-over mandrel transferring load between the upper and lower mandrels. In a preferred embodiment, the load cross-over mandrel defines several longitudinal passages through which rods of the displacement assembly slide. The tool string can also include release assemblies, etc. The arrangement of the mandrel assembly allows for quick and easy assembly or make-up on a rig floor and eliminates the need for a pressure test on the assembled tool.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

Figure 1A:
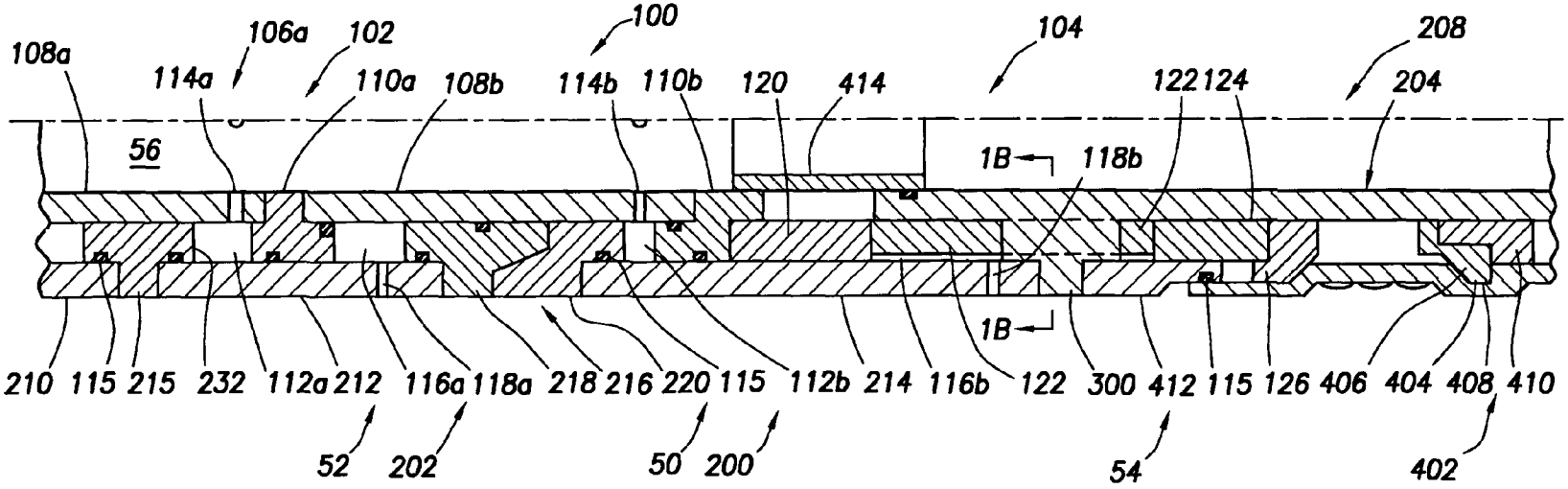
FIG. 1 is a schematic view of an exemplary embodiment of a running tool according to an aspect of the invention with FIG. 1A in longitudinal cross-section and FIG. 1B in radial cross-section.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The description is provided with reference to a vertical wellbore; however, the inventions disclosed herein can be used in horizontal, vertical or deviated wellbores. As used herein, the words "comprise," "have," "include," and all grammatical variations thereof are each intended to have an open, non-limiting meaning that does not exclude additional elements or steps. It should be understood that, as used herein, "first," "second," "third," etc., are arbitrarily assigned, merely differentiate between two or more items, and do not indicate sequence. Furthermore, the use of the term "first" does not require a "second," etc. The terms "uphole," "downhole," and the like, refer to movement or direction closer and farther, respectively, from the wellhead, irrespective of whether used in reference to a vertical, horizontal or deviated borehole. The terms "upstream" and "downstream" refer to the relative position or direction in relation to fluid flow, again irrespective of the borehole orientation. Although the description may focus on a particular means for positioning tools in the wellbore, such as a tubing string, coiled tubing, or wireline, those of skill in the art will recognize where alternate means can be utilized. As used herein, "upward" and "downward" and the like are used to indicate relative position of parts, or relative direction or movement, typically in regard to the orientation of the Figures, and does not exclude similar relative position, direction or movement where the orientation in-use differs from the orientation in the Figures.

A purpose of the inventions described herein is to greatly simplify rig floor assembly of extended length Liner Hanger Running Tools and the like. Although the description is provided in reference to a liner hanger running tool, those of skill in the art will recognize additional running tools and assemblies in which the inventive features can be used. Typical liner hanger running tools consist of an outer cylinder to transfer expansion force and inner mandrel to transfer running tool loads. Make-up of two halves of the normal running tool on the rig floor requires make-up of the inner mandrel and the outer cylinder. This is an awkward process and it is time consuming. Additionally traditional make-up connections require a pressure test after assembly which is difficult or prohibitive to conduct on the rig floor. This invention requires only a simple tool joint connection to be made up to connect two halves of a tool on the rig floor, and no pressure testing would be required. Normally, the tensile and torsion loads are all transferred through the inner mandrel and the external cylinder applies the displacement forces onto the expansion cone. This mechanism allows the loading of the inner and outer members to be reversed for the force multiplier section of the tool because, through the crossover body, the functions of the outer and inner members are reversed back to provide normal tool operation.

Figure 1B:
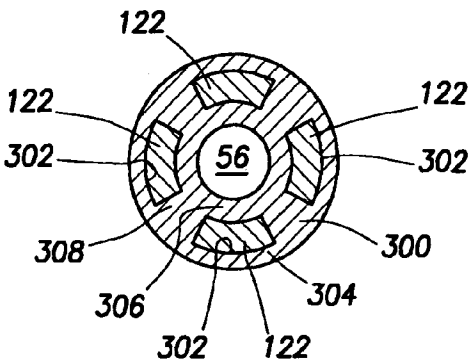
Figure 21:
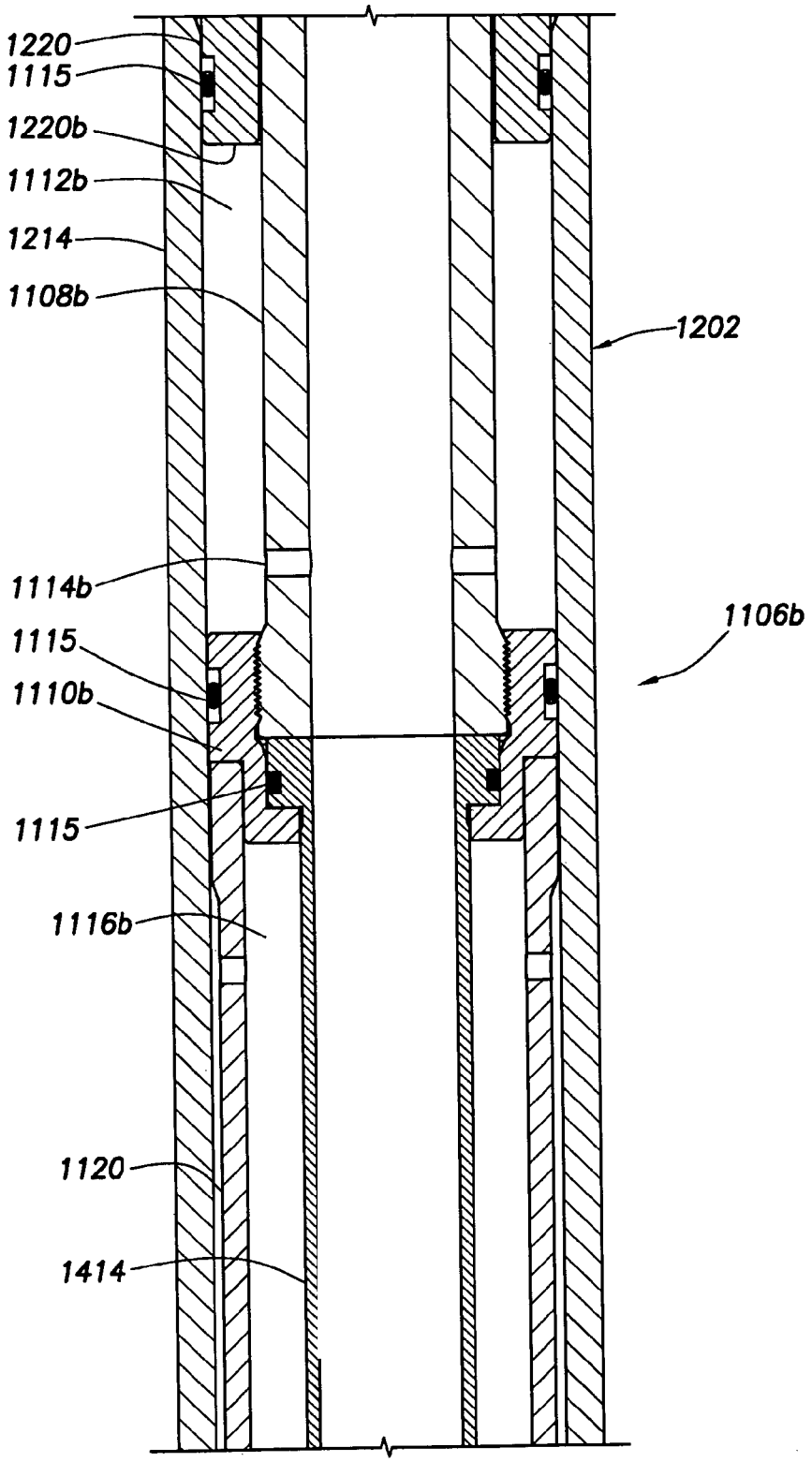

FIG. 1A is a cross-sectional schematic of an exemplary running tool with load cross-over assembly according to an aspect of the invention. FIG. 1A is a schematic, cross-sectional view of a liner hanger running tool according to an aspect of the invention. FIG. 1B is a cross section drawing taken at line 1B-1B of FIG. 1A. A liner hanger running tool assembly 50 is shown generally having a displacement assembly 100 which, among other things, bears the displacement load during actuation, and a tensile and torsional load-bearing assembly 200 which, among other things, bears the tensile and torsional load placed on the tool during run-in, pull-out of hole and operation. The running tool assembly 50 is generally divided into an upper portion 52 and lower portion 54.

The tensile and torsional load-bearing assembly 200 is generally comprised of a substantially cylindrical upper mandrel 202 and a substantially cylindrical lower mandrel 204. The use of the term "mandrel" does not indicate that the mandrel is positioned at a radially inward, interior, or axial location in the tool; instead, "mandrel" is used to indicate the portions of the tool carrying the tensile load through the tool. Where the tool parts are locked rotationally, the mandrel carries the torsional loads on the tool as well. The term "mandrel" also is not meant to indicate that the mandrel is solid in cross-section. In fact, both the upper and lower mandrels described herein define interior passageways for the transmission of fluid, cement, and the like, or for encasing portions of the displacement assembly, pistons, piston sleeves or rods, and the like. In prior art tools, the tensile load-bearing mandrel is positioned interior to the tool housing and interior to the displacement assembly, namely, the sliding sleeves, piston sleeves, or the like, of the displacement assembly.

The displacement assembly 100 has an upper displacement assembly 102 and a lower displacement assembly 104. The displacement assembly 100 provides for relative motion between the displacement assembly and tensile load-bearing assembly and carries the displacement loads during displacement, setting or expansion. In prior art tools, the displacement assembly, often a series of hydraulically actuated piston assemblies, is positioned radially outward from or around an inner tensile and rotational load-bearing mandrel.

According to an aspect of the invention, the upper mandrel 202 is positioned exterior to or radially outward from the upper displacement assembly 102. Hence, the tensile load in the upper section 52 of the tool assembly is carried exterior to the upper displacement assembly. Stated another way, the upper displacement assembly 102 is positioned within (and relatively moves within) the upper mandrel 202, and the displacement load is carried interior to the upper mandrel. The upper mandrel preferably forms the outer housing of the tool assembly, as shown, however, the upper mandrel can have a protective sleeve or other member positioned exterior thereto.

The lower mandrel 204 is positioned interior to or radially inward from the lower displacement assembly 104. Hence, the tensile load in the lower section 54 of the tool assembly is carried interior to the lower displacement assembly 104. Stated another way, the lower displacement assembly 104 is positioned exterior to (and relatively moves outside of) the lower mandrel 204, and the displacement load is carried exterior to the lower mandrel. The lower mandrel is preferably the inner-most portion of the tool along the lower section, defining the passageway 56 along that section, however, the inner mandrel can have pass-through sleeves and the like positioned radially inward thereof.

Transferring the tensile load from the upper, exterior mandrel 202 to the lower, interior mandrel 204, is a load cross-over joint 300. The load cross-over joint 300 also allows relative movement of the displacement assembly therethrough, effectively transitioning the movable displacement assembly from interior the upper mandrel to exterior the lower mandrel. In a preferred embodiment, the cross-over joint is a slip joint. The load cross-over joint can also be referred to as a cross-over mandrel. A tensile load path can be traced through the running tool assembly through the upper mandrel 202, through load cross-over joint 300, to lower mandrel 204. Similarly, a displacement load path can be traced through the upper displacement assembly 102 (bypassing the load cross-over tool 300), and into the lower displacement assembly 104.

The tensile load-bearing assembly 200 more particularly includes an upper mandrel 202, which is shown as a generally cylindrical member. Multiple such members can be joined together to create a longer upper mandrel. As seen, the upper mandrel 202 is made-up of a first, second and third upper mandrel member, 210, 212 and 214, respectively. The members 210 and 212 are joined by a tensile load cylinder coupling 215. Similarly, the second and third members 212 and 214 are connected by a tool joint coupling 216. Stated another way, the upper mandrel can be thought of as comprising the first, second and third mandrel members 210, 212 and 214, as well as their connections, the tensile load coupling 215 and upper and lower members of the tool joint coupling 216. The third upper mandrel member 214 is attached to the load cross-over joint 300.

The tool joint coupling 216 is a typical make-up joint used in many oilfield tools. It is easy to assemble, can be assembled on a rig floor, and does not require associated o-rings or seals, and so does not require a pressure test after connection. The tool joint coupling 216 has an upper joint coupling member 218 which releasably connects to a lower tool joint coupling member 220.

The lower mandrel assembly 208 has a lower mandrel 204 attached to the load cross-over joint 300. The lower mandrel extends downward and can interact with the release or collet assembly, such as is known in the art. The lower mandrel assembly can be made-up of multiple members, such as attached lengths of inner mandrel to provide desired length, or tubular members serving additional functions, such as a collet sleeve, etc.

The mandrel assembly is designed to provide the load-bearing capacity of a typical inner mandrel. The cross-sectional area, material, tensile strength and other characteristics of the exemplary cross-over mandrel are sufficient to bear the tensile load applied to the mandrel. For example, the mandrel assembly is capable of holding up a liner string. Further, the mandrel assembly bears the torsional loading on the string as well in most embodiments. However, unlike the typical mandrel, the cross-over mandrel provides tensile load-bearing members exterior to the displacement assembly at an upper end of the tool and tensile load-bearing members interior to the displacement assembly at a lower end of the tool. The tensile and rotational load-bearing path, in the embodiment shown, passes through the following members: the first upper mandrel member 210, the tensile load cylinder coupling 215, second mandrel member 212, upper tool joint coupling member 218, lower tool joint coupling member 220, third mandrel member 214, load cross-over joint 300, and lower mandrel 204.

The mandrel assembly members can also serve additional functions. For example, the load cylinder coupling 214 provides a lower face 232 on which high pressure fluid in piston chamber 112*a* acts. Seals 115 are provided as necessary. The interior surface of the upper mandrel member 202 provides a surface on which the piston 110*a* moves and partially defines the chambers 112*a* and 116*a*. Similarly, the upper and lower tool joint coupling members 218 and 220 partially define pressure chambers 116*a* and 112*b*. Details such as these are known in the art and not described in detail. Further, mandrel assembly members can provide motion limiting surfaces and shoulders, abutment and landing shoulders, connecting pins, and the like.

An exemplary displacement assembly 100 has one or more piston assemblies 106. Multiple piston assemblies 106 can be arranged in a longitudinal series, as is known in the art, to increase displacement force or stroke length of the tool. Each piston assembly 106 includes a piston rod or sleeve 108, piston 110, high pressure chamber 112, and a pressure port 114 for communicating hydraulic pressure to the corresponding pressure chamber. In the preferred embodiment, the hydraulic pressure is supplied by pressuring-up on the fluid in the interior passageway 56 of the tool assembly. The pressure is transferred from the interior passageway, through the pressure ports and into the pressure chambers. Pressure causes movement of the piston. In a preferred embodiment, the high pressure chambers 112 are defined in an annular space between mandrel and displacement sleeve. Low pressure vent chambers 116 are provided adjacent each piston, opposite high pressure chambers 112, with fluid in the vent chambers vented through vent ports 118 to the exterior of the tool. Various seals 115 can be employed, as is known in the art, between piston sleeves, pistons, couplings, etc.

The embodiment in FIG. 1A shows two piston assemblies 106*a-b*, with corresponding parts labeled with corresponding letters in each assembly. More or fewer piston assemblies may be used, but for lengthy tool assemblies or applications requiring greater displacement force or stroke, it is anticipated that multiple piston assemblies will be used. Further, the exemplary embodiment shown has a piston assembly above the joint coupling assembly 400, and one piston assembly below. This is an exemplary arrangement and multiple piston assemblies can be positioned above or below the joint coupling assembly.

The displacement assembly 100 further includes an assembly for transferring the displacement load to an expansion cone, packer slip assembly, etc. The exemplary lower displacement assembly 104 seen here is an expansion assembly. The lowest piston assembly, here piston 110*b*, transfers displacement motion and force to an upper expansion sleeve 120. Extending longitudinally downward from the upper expansion sleeve are a plurality of displacement load transfer members 122. The displacement load transfer members, or "fingers," transfer displacement load to the lower expansion sleeve 124 and thence to the expansion cone 126. The expansion cone 126 is displaced longitudinally to expand the expandable liner hanger 400.

FIG. 1B provides a cross-sectional view of the load cross-over joint 300. The displacement load transfer members 122 pass through corresponding openings 302 in the load cross-over joint 300. Exemplary load transfer members 122 are shown, namely, four members extending through four corresponding openings 302. However, other numbers of load transfer members and openings can be used. Further, although a preferred cross-sectional shape of the members 122 is shown, other shapes can be employed. The cross-over joint 300 is shown in an exemplary embodiment, defining an exterior annular portion 304, an interior annular portion 306, and webs 308 connecting the annular portions and extending radially between adjacent openings 302. The cross-over joint 300 also defines a portion of interior passageway 56 for passage of fluids therethrough. The interior passageway 56 can be defined by several members including piston sleeves, couplings, pistons, cross-over mandrel, lower mandrel, collet sleeve, etc.

After completion of the downhole operation, the running tool assembly is released from the expanded or set downhole tool. Here, the running tool is disconnected from the now-expanded liner hanger. Several types of disconnection assembly are known in the art, one of which is a collet assembly 402. The collet assembly includes a collet 404 with lugs 406 latched into corresponding recesses 408 on the interior of the hanger. A collet prop nut 410 maintains the collet in locked position to the liner hanger. The collet is disconnected from the liner hanger by placing weight-down on the tool assembly.

Additional tool members can be employed as are known in the art, such as debris sleeve 412, pass-through sleeve 414, etc.

FIG. 2 is a cross-sectional view of one embodiment of an exemplary tool having a load cross-over joint according to an aspect of the invention. FIGS. 2A-R are sequential drawings of an exemplary tool in cross section according to aspects of the invention.

Turning to FIG. 2, a liner hanger running tool assembly 1050 is presented having a displacement assembly 1100, including a displacement load-bearing assembly 1101, and a tensile and torsional load-bearing assembly 1200. The upper end of the assembly 1050 seen in the FIG. 2A, is a piston assembly interior to a tensile load-bearing cylinder or mandrel, as discussed herein. Not shown, uphole of the assembly, are additional piston assemblies, running tool, tool string, etc., as are known in the art. Piston assemblies are known in the art and can be stacked or arranged in series to provide additional stroke force or displacement as needed. Similarly, not shown downhole of the assembly of FIG. 2R, is further liner hanger, liner, disconnect assembly such as a collet assembly, etc., as are known in the art. The liner hanger running tool assembly 1050 is shown generally having a displacement assembly 1100 having a displacement load-bearing assembly 1101, and a tensile and torsional load-bearing assembly 1200. The running tool assembly 1050 is generally divided into an upper portion 1052 and lower portion 1054.

The tensile and torsional load-bearing assembly 1200 is generally comprised of a substantially cylindrical upper mandrel 1202 and a substantially cylindrical lower mandrel 1204. The upper and lower mandrels carry the tensile and torsional loads placed on the assembly during use. The upper and lower mandrels both define a fluid flow passageway therethrough for allowing, for example, cement, treatment fluid, hydraulic pressure fluid, and the like, to pass through the mandrels and assembly. Generally, the through-passageway 1056 extends from the upper to the lower end of the assembly and can be defined at various portions by the interior surface of the displacement assembly, the interior surface of the mandrel assembly, by a sleeve positioned in the assembly for that purpose, etc. Both the upper and the lower mandrel described herein define interior passageways for transmission of fluid, cement, and the like, or for encasing portions of the displacement assembly, pistons, piston sleeves or rods, and the like.

The displacement assembly 1100 has an upper displacement assembly 1102 and a lower displacement assembly 1104. The displacement assembly 1100 provides for relative motion between the displacement assembly and tensile load-bearing assembly and carries the displacement loads during displacement, setting or expansion of an actuated tool positioned below the displacement assembly.

The upper mandrel 1202 is positioned exterior to or radially outward from the upper displacement assembly 1102. Hence, the tensile and torsional loads in the upper section 1052 of the tool assembly 1050 are carried exterior to the upper displacement assembly. Stated another way, the upper displacement assembly 1102 is positioned within, and moves relative to and within, the upper mandrel 1202. The displacement load is carried interior to the upper mandrel. The upper mandrel preferably forms the outer housing of the tool assembly, as shown, however, the upper mandrel can have a protective sleeve or other member positioned exterior thereto.

The lower mandrel 1204 is positioned interior to or radially inward from the lower displacement assembly 1104. Hence, the tensile load in the lower section 1054 of the tool assembly is carried interior to the lower displacement assembly 1104. Stated another way, the lower displacement assembly 1104 is positioned exterior to (and relatively moves outside of) the lower mandrel 1204, and the displacement load is carried exterior to the lower mandrel. The lower mandrel is preferably the inner-most portion of the tool along the lower section, defining the passageway 1056 along that section. However, the inner mandrel can have pass-through sleeves, valves such as a ball-drop seat valve, support sleeves, pins and joints, and the like, positioned radially inward thereof.

Transferring the tensile load from the upper, exterior mandrel 1202 to the lower, interior mandrel 1204, is a load cross-over joint 1300. The load cross-over joint 1300 also allows movement of the displacement assembly therethrough, effectively transitioning the movable displacement assembly from interior the upper mandrel to exterior the lower mandrel. A tensile load path, T, can be traced through the running tool assembly through the upper mandrel 1202, through load cross-over joint 1300, to lower mandrel 1204. Similarly, a displacement load path, D, can be traced through the upper displacement assembly 1102 (bypassing the load cross-over tool 1300), and into the lower displacement assembly 1104.

The tensile load-bearing assembly 1200 more particularly includes an upper mandrel 1202, which is shown as a generally cylindrical member. Multiple such members can be joined together to create a longer upper mandrel. As seen, the upper mandrel 1202 is made-up of a first, second and third upper mandrel member, 1210, 1212 and 1214, respectively. The members 1210 and 1212 are joined by a tensile load cylinder coupling 1215. Similarly, the second and third members 1212 and 1214 are connected by a tool joint coupling 1216. The third upper mandrel member 1214 is attached to the load cross-over joint 1300.

The tool joint coupling 1216 is a typical make-up joint used in many oilfield tools. It is easy to assemble, can be assembled on a rig floor, and does not require associated pressure o-rings or seals, and so does not require a pressure test after connection. The tool joint coupling 1216 has an upper joint coupling member 1218 which releasably connects, at connection 1219, to a lower tool joint coupling member 1220. The upper tool joint coupling 1218 includes parts known in the art, including threads, seals, connector pin assemblies 1221, contact surfaces 1223, etc. Similarly, the lower tool joint coupling 1220 includes contact surface 1225, threads, connector pin assemblies 1227, The lower mandrel assembly 1208 has a lower mandrel 1204 attached to the load cross-over joint 1300. The lower mandrel extends downward and can interact with the release or collet assembly, expansion cone, etc., such as is known in the art.

The mandrel assembly is designed to provide the load-bearing capacity of a typical inner mandrel. The cross-sectional area, material, tensile strength and other characteristics of the exemplary cross-over mandrel are sufficient to bear the tensile load applied to the mandrel. For example, the mandrel assembly is capable of holding up a liner string. Further, the mandrel assembly bears the torsional loading on the string as well in most embodiments. However, unlike the typical mandrel, the cross-over mandrel provides tensile load-bearing members exterior to the displacement assembly at an upper end of the tool and tensile load-bearing members interior to the displacement assembly at a lower end of the tool. The tensile and rotational load-bearing path, in the embodiment shown, passes through the following members: the first upper mandrel member 1210, the tensile load cylinder coupling 1215, mandrel member 1212, upper tool joint coupling member 1218, lower tool joint coupling member 1220, mandrel member 1214, load cross-over joint 1300, and lower mandrel 1204.

The mandrel assembly members can also serve additional functions. For example, the load cylinder coupling 1215 provides a downward face 1232 on which high pressure fluid in piston chamber 112*a* acts. The load cylinder coupling 1215 also includes threaded connections 1215*a*, providing a tensile load path from the upper mandrel 1210, through the coupling 1215, and into upper mandrel member 1212. Pin assemblies 1215*b*, such as torque pin assemblies, are provided to rotationally lock and connect the load cylinder coupling 1215 to the upper mandrel members 1210 and 1212. Other types of equivalent load cylinder couplings or attachments can be used, as are known in the art. Seals 1115 are provided between parts as necessary. The exemplary load cylinder coupling 1215 is slidably engaged at surface 1215*c*, to piston rod 1108*a*.

The interior surface of the upper mandrel member 1202 provides a surface on which the piston 1110*a* slides and partially defines the pressure chambers 1112*a* and 1116*a*. Similarly, the upper and lower tool joint coupling members 1218 and 1220 partially define pressure chambers 1116*a* and 1112*b* at surfaces 1218*a* and 1220*a* respectively. Further, mandrel assembly members can provide motion limiting shoulders and the like.

An exemplary displacement assembly 1100 has one or more piston assemblies 1106. Multiple piston assemblies 1106*a-b* can be arranged in series, as known in the art, to increase displacement force or stroke length of the tool. Each piston assembly 1106*a-b* includes a corresponding piston rod or sleeve 1108*a-b*, piston 1110*a-b*, a high pressure chamber 1112*a-b*, and a pressure port 1114*a-b* for communicating hydraulic pressure to the corresponding high pressure chamber. In the preferred embodiment, the hydraulic pressure is supplied by pressuring-up on the fluid in the interior passageway 1056 of the tool assembly. The pressure is transferred from the interior passageway 1056, through the pressure ports 1114 and into the pressure chambers 1112. Pressure forces relative movement of the piston 1110. In a preferred embodiment, the high pressure chambers 1112 are defined in an annular space between the mandrel and displacement sleeve. Preferably, low pressure vent chambers 1116*a-b* are provided adjacent each piston, opposite the high pressure chambers 1112*a-b*, with fluid in the vent chambers vented through vent ports 1118 to the exterior of the tool. Various seals 1115 can be employed, as is known in the art, between piston sleeves, pistons, couplings, etc.

For example, the piston 1110*a* is an annular piston housed between the upper mandrel 1212 and annular piston rod or sleeve 1108*a*. The piston 1110*a* is in sliding engagement with the mandrel at surface 1113*a*. The piston 1110*a* abuts piston rod 1108*a* at a shoulder 1115*a*, such that downward motion of the piston rod drives the piston downward. The piston 1110*a* also abuts a lower piston rod 1108*b* at shoulder 1117*a*, such that movement of the piston downward moves the piston rod downward. Fluid from the bore 1056 of the string is pressured up and communicates pressure through pressure ports 1114*a* to the high pressure chamber 1112*a*. The upward facing surfaces 1111*a* of the piston are acted upon by the high pressure, thus moving the piston downward. The high pressure chamber 1112*a*, in this embodiment, is defined by the interior surface of the upper mandrel 1212, the exterior surface of the piston rod 1108*a*, the lower surface 1232 of the load cylinder coupling 1215, and the upper and other surfaces of the piston 1110*a*. As the piston moves downward, it increases pressure in vent chamber 1116*a*. Fluid in the vent chamber exits the tool via vent ports 1118*a*. Screens, tortuous paths, etc., may intervene to prevent debris problems. In the embodiment shown, fluid from the vent chamber 1116*a* exits the tool through vent port 1118*a* in upper mandrel 1212 after passing through a preliminary port 1119*a* through upper tool joint coupling 1218.

The embodiment in FIG. 2 shows two piston assemblies 1106*a-b*, with corresponding parts labeled with corresponding letters in each assembly. More or fewer piston assemblies may be used, but for lengthy tool assemblies or applications requiring greater displacement force or stroke, it is anticipated that multiple piston assemblies will be used. Further, the exemplary embodiment has one piston assembly above and another below, the joint coupling assembly 1400. This is an exemplary arrangement and multiple piston assemblies can be positioned above and/or below the joint coupling assembly.

The displacement assembly 1100 further includes an assembly for transferring the displacement load to an expansion cone, packer slip assembly, etc. The exemplary lower displacement assembly 1104 seen here is an expansion assembly, although only a portion of the expansion assembly is shown. The lowest piston assembly, here piston 1110*b*, transfers displacement motion and force to an upper expansion sleeve 1120. The upper expansion sleeve abuts, at shoulder 1121, a pass-through displacement member 1122.

The pass-through displacement assembly 1122, in a preferred embodiment, has a plurality, here four, longitudinally extending displacement load transfer members 1122*a-d*, or "fingers." The pass-through displacement assembly is so-called since it transfers displacement load and motion past the tensile load cross-over assembly. The displacement load fingers transfer displacement load to the lower expansion sleeve 1124 and thence to an expansion cone (not shown). The lower expansion sleeve 1124 can be assembled from multiple members 1124*a-b*, which abut at cooperating shoulder 1125. The expansion cone is displaced longitudinally downward to expand the expandable liner hanger 1400. The pass-through displacement assembly can comprise multiple parts in connection or abutment and have differing structure from the exemplary embodiment shown. The pass-through displacement assembly, in an embodiment, includes one or more annular members extending between and connecting to the multiple fingers. The annular members can be removably attached to the fingers, such as by threads, pins, etc., for assembly purposes and to transfer displacement forces. The annular member may also serve to provide shoulders or interactive parts to limit displacement, for example.

The pass-through displacement assembly load transfer members 1122*a-d* are under load during displacement or actuation of the tool assembly. The transfer members are of relatively wider cross-section, as compared to the upper expansion sleeve 1120 for example, to support the displacement load. Further, since the fingers will tend to fail by buckling under load, radial support is provided by an upper cross-over mandrel guide 1203, positioned radially inward from the fingers, and an exterior radial support sleeve 1205, positioned radially outward from the fingers and extending from the cross-over joint 1300 to a debris sleeve 1412.

The exemplary load cross-over joint 1300 transfers tensile and torsional load from the upper mandrel 1200, at sleeve 1214, to the lower mandrel 1204. The load cross-over joint (or cross-over mandrel) is threadedly attached at threads 1310 to upper mandrel 1214, transferring tensile load between the members. Further, pins (not shown) at pin hole 1312 transfer torque between the upper mandrel and cross-over mandrel. The cross-over joint 1300 is preferably formed having an exterior or outer annular ring 1304 and an interior or inner annular ring 1306 joined by radially extending webs 1308. The webs and rings define four pass-through openings 1302 which allow longitudinal movement of the displacement load fingers 1122 therethrough. Longitudinally extending downward is lower inner mandrel 1204. Longitudinally extending upward, attached to the joint at connection 1311 by pins or the like, is the cross-over mandrel guide 1203, which also acts as a radial support sleeve for the fingers. Both the mandrel guide and lower inner mandrel are preferably substantially cylindrical, as shown, further defining the passageway 1056. Further, both preferably have cooperating longitudinal grooves or splines which cooperate with the fingers 1122. Further reference is made to FIGS. 3-7.

Figure 2A:
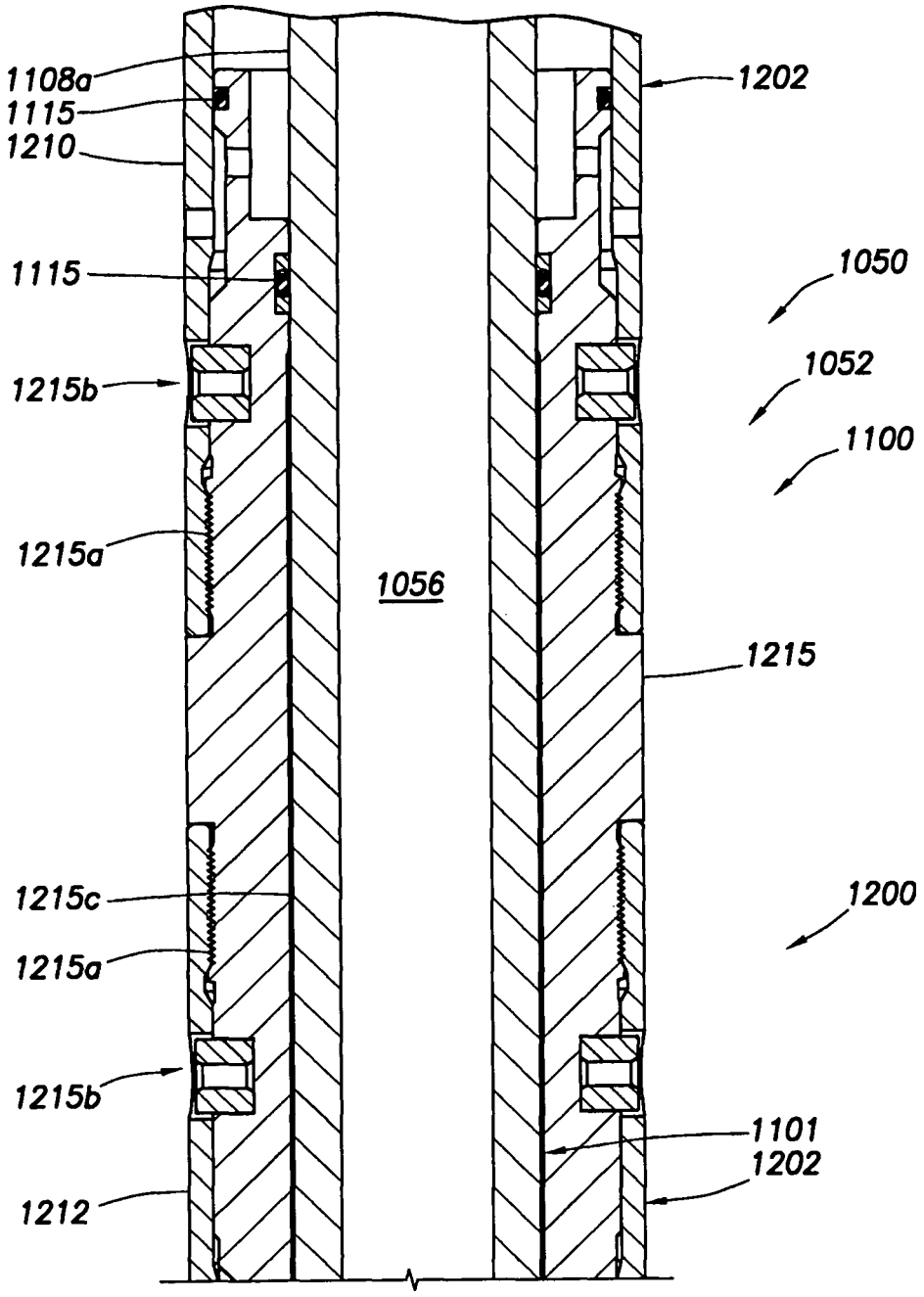
FIG. 2 is a cross-sectional view of one embodiment of an exemplary tool having a load cross-over joint according to an aspect of the invention with FIGS. 2A-R being sequential drawings of an exemplary tool in cross section according to aspects of the invention.
Figure 2B:
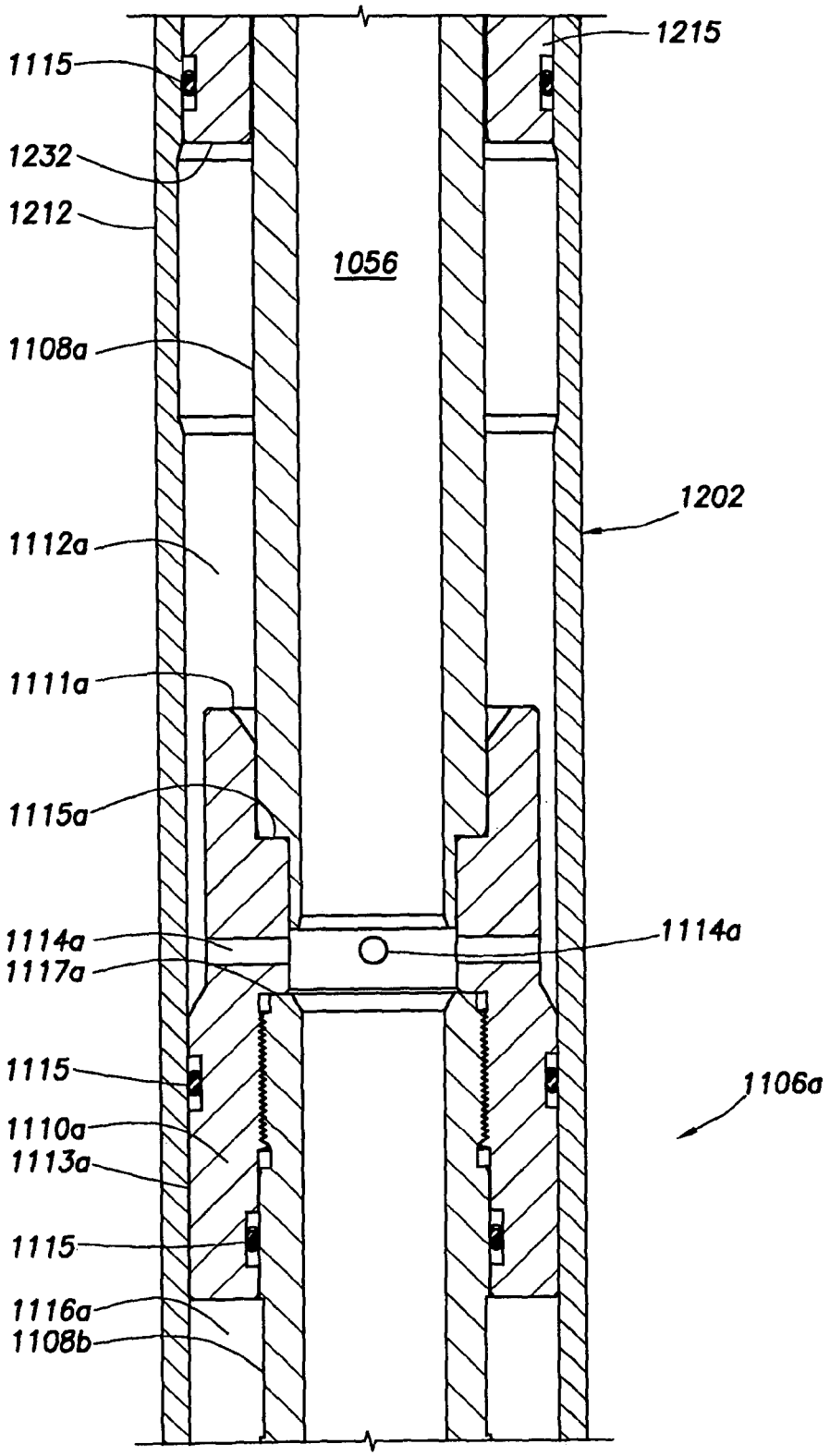
Figure 2C:
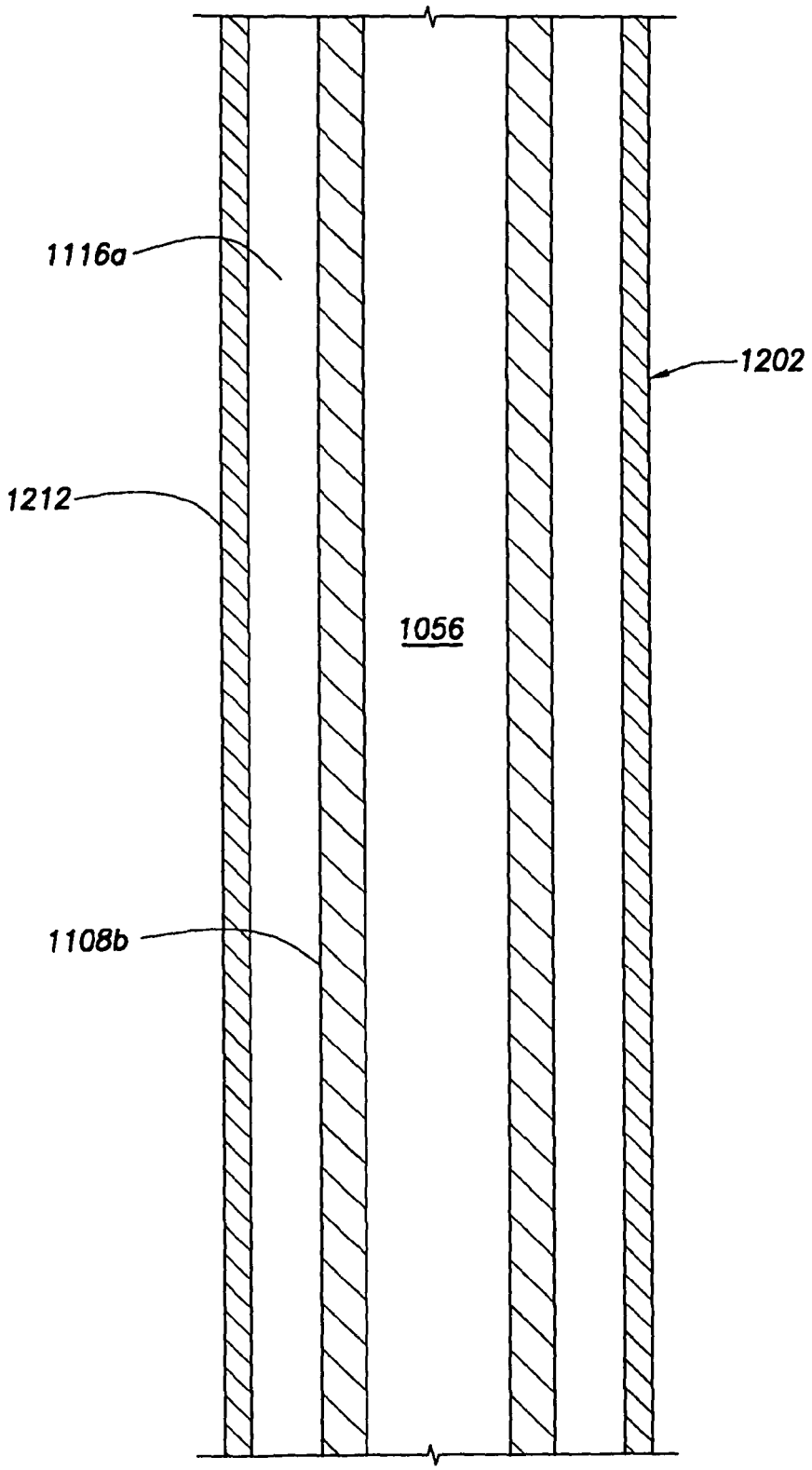
Figure 2D:
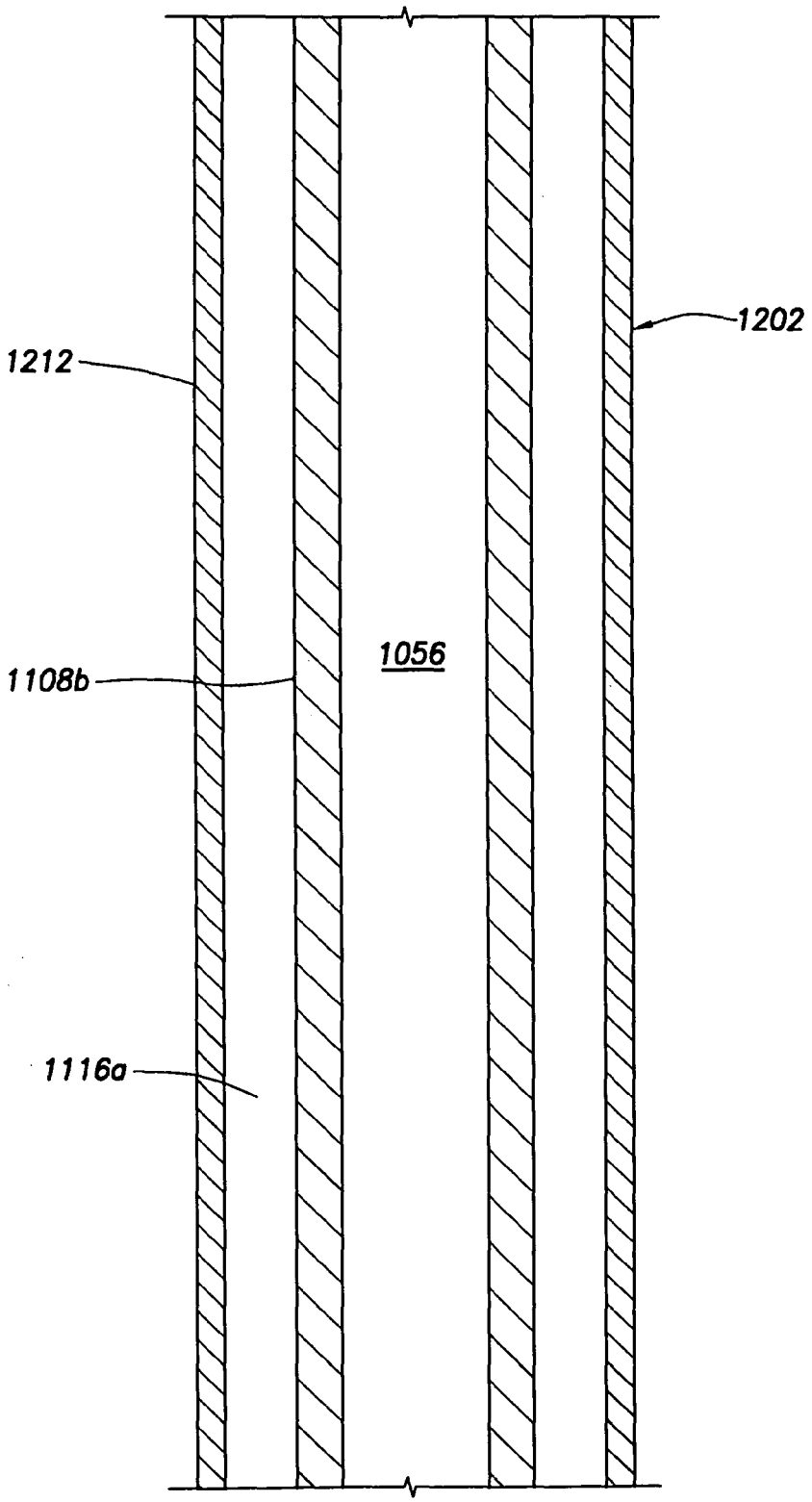
Figure 2E:
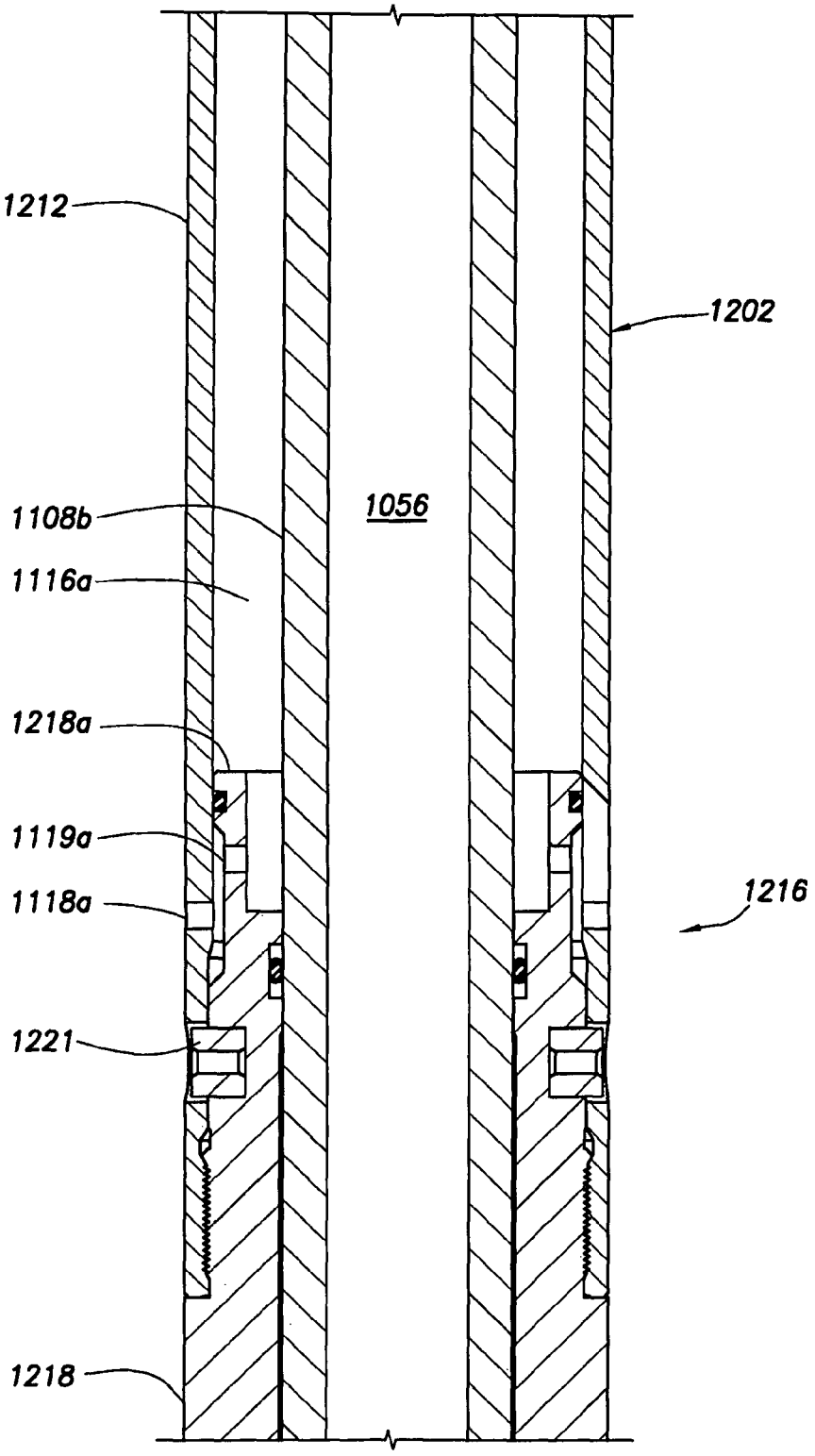
Figure 2F:
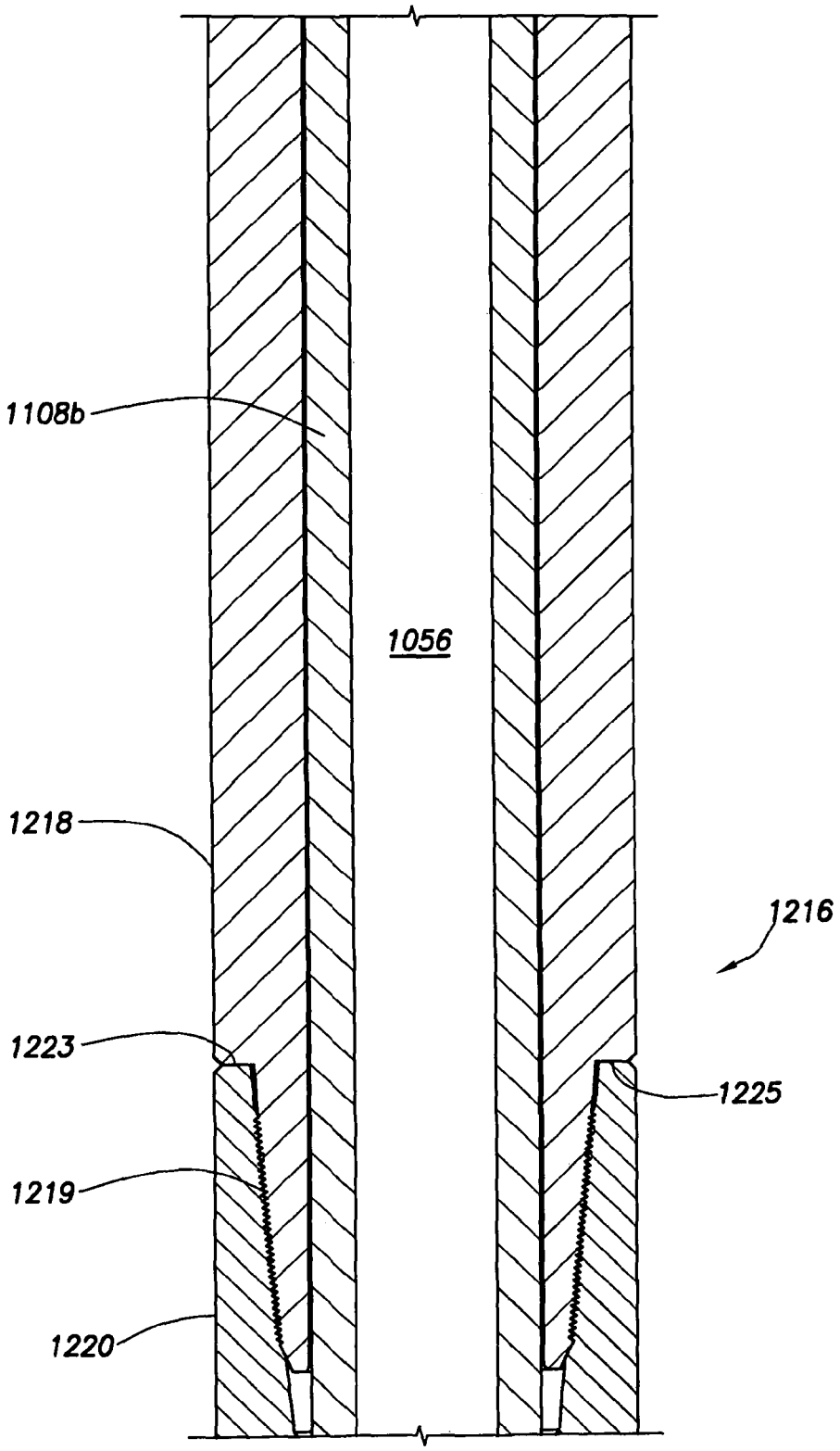
Figure 2G:
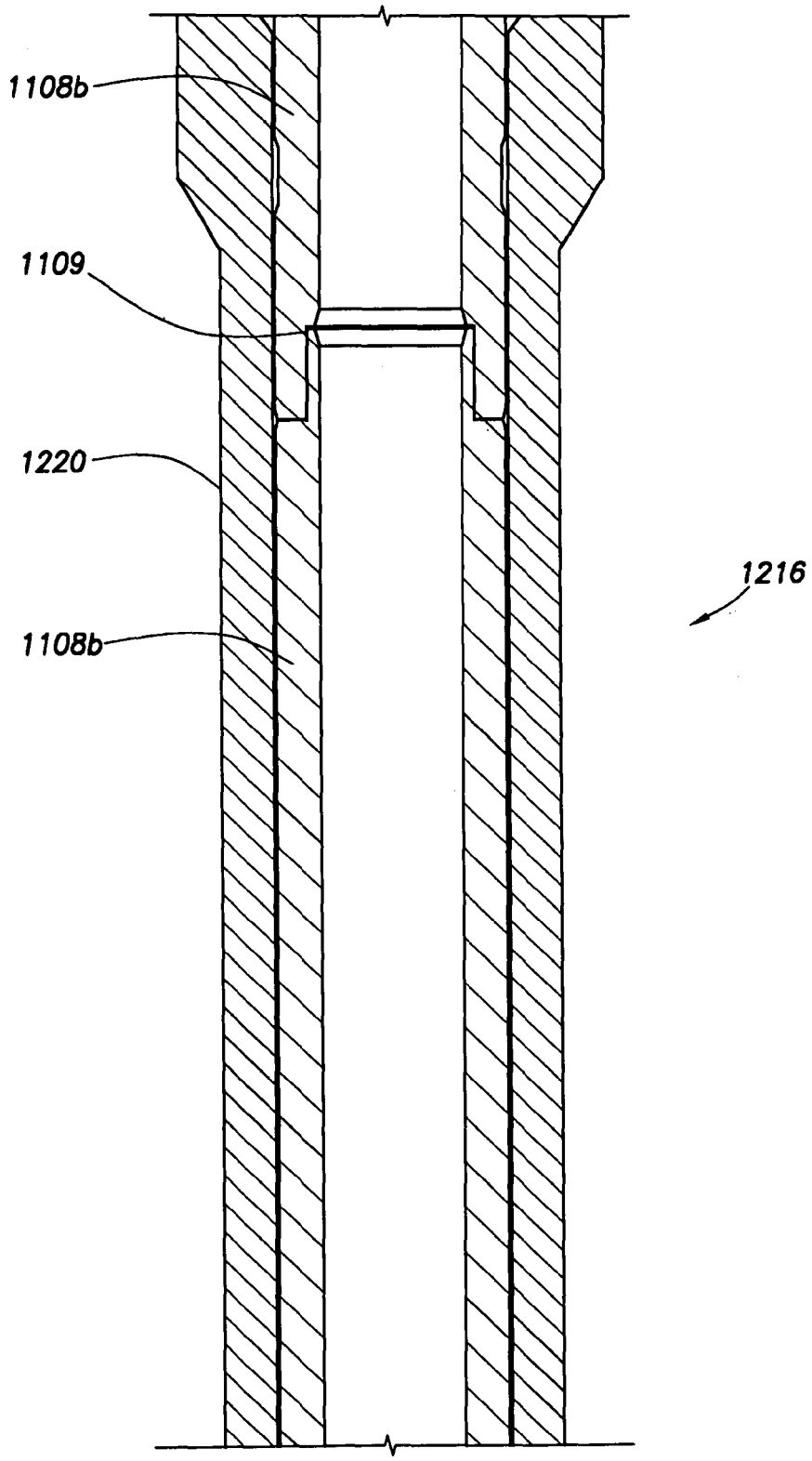
Figure 2H:
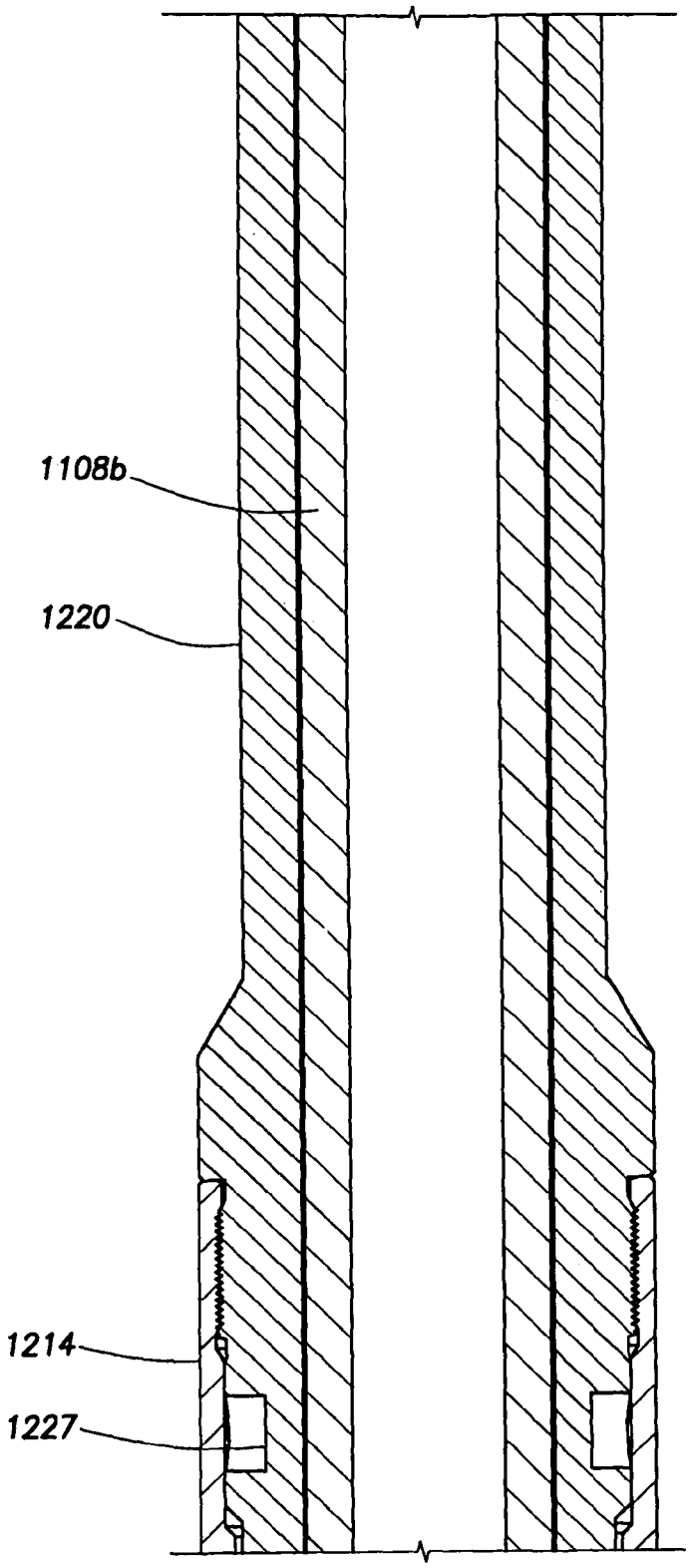
Figure 2J:
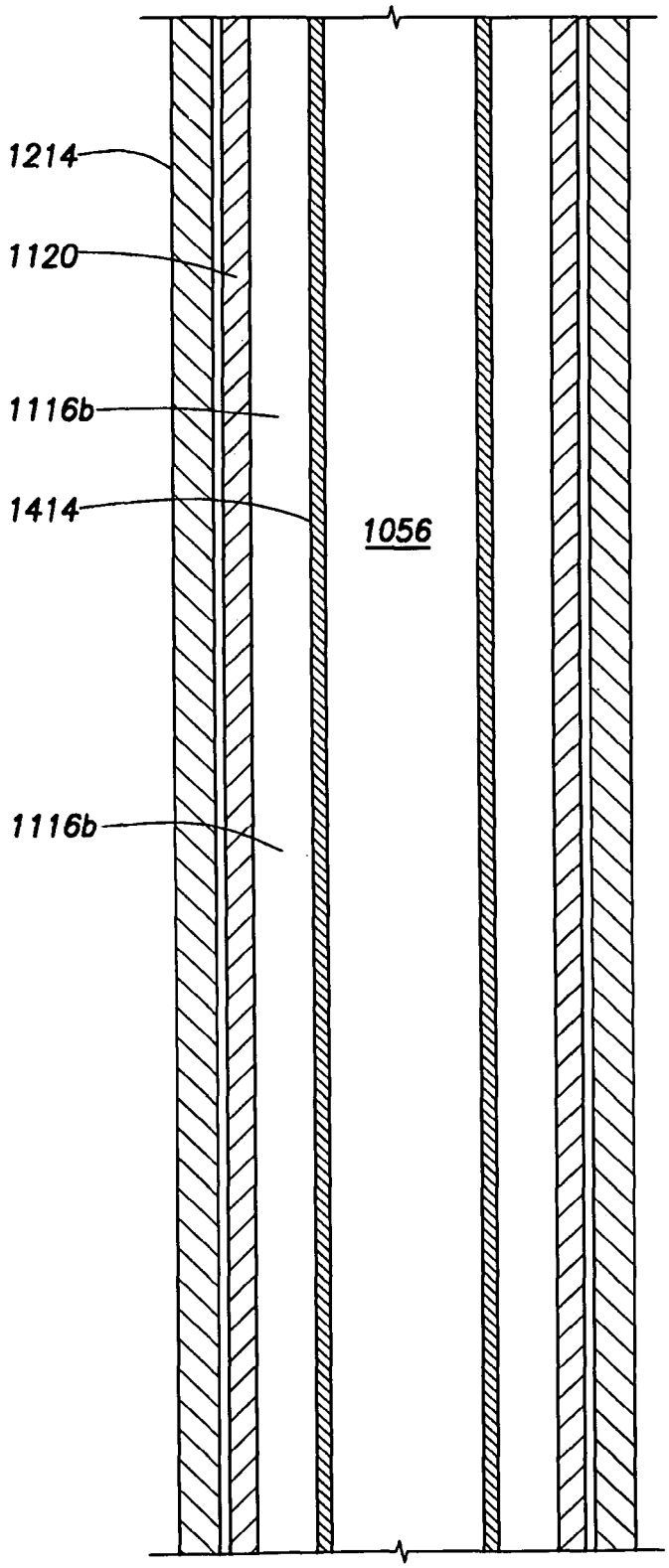
Figure 2K:
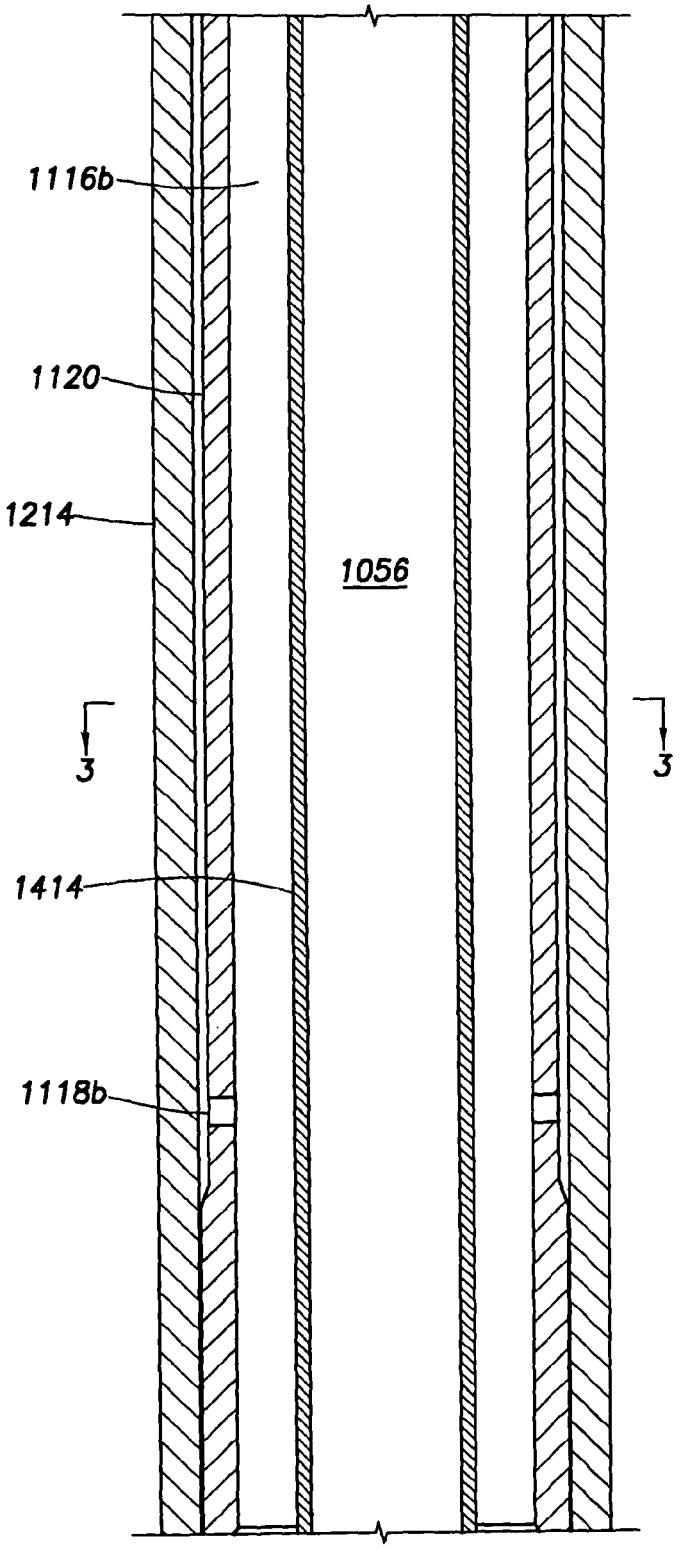
Figure 3:
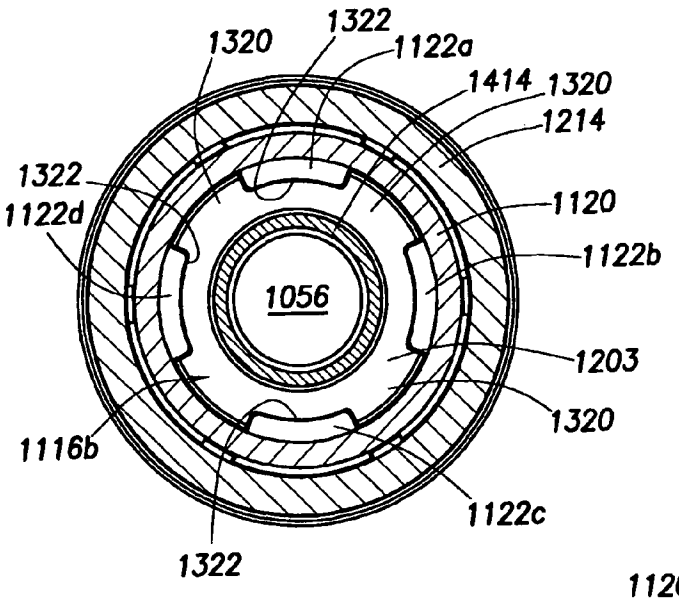
FIG. 3 is a cross-sectional view taken along line 3-3 of FIG. 2 looking downward.

FIG. 3 is a cross-sectional view of the tool assembly taken along line 3-3 of FIG. 2K, looking downward. Like numbers refer to like parts and will not all be addressed here. Of note, the upper surfaces of the displacement load transfer members 1122*a-d* (fingers) are seen cooperating with corresponding longitudinal splines 1320 and grooves 1322 of the mandrel guide 1203.

Figure 2L:
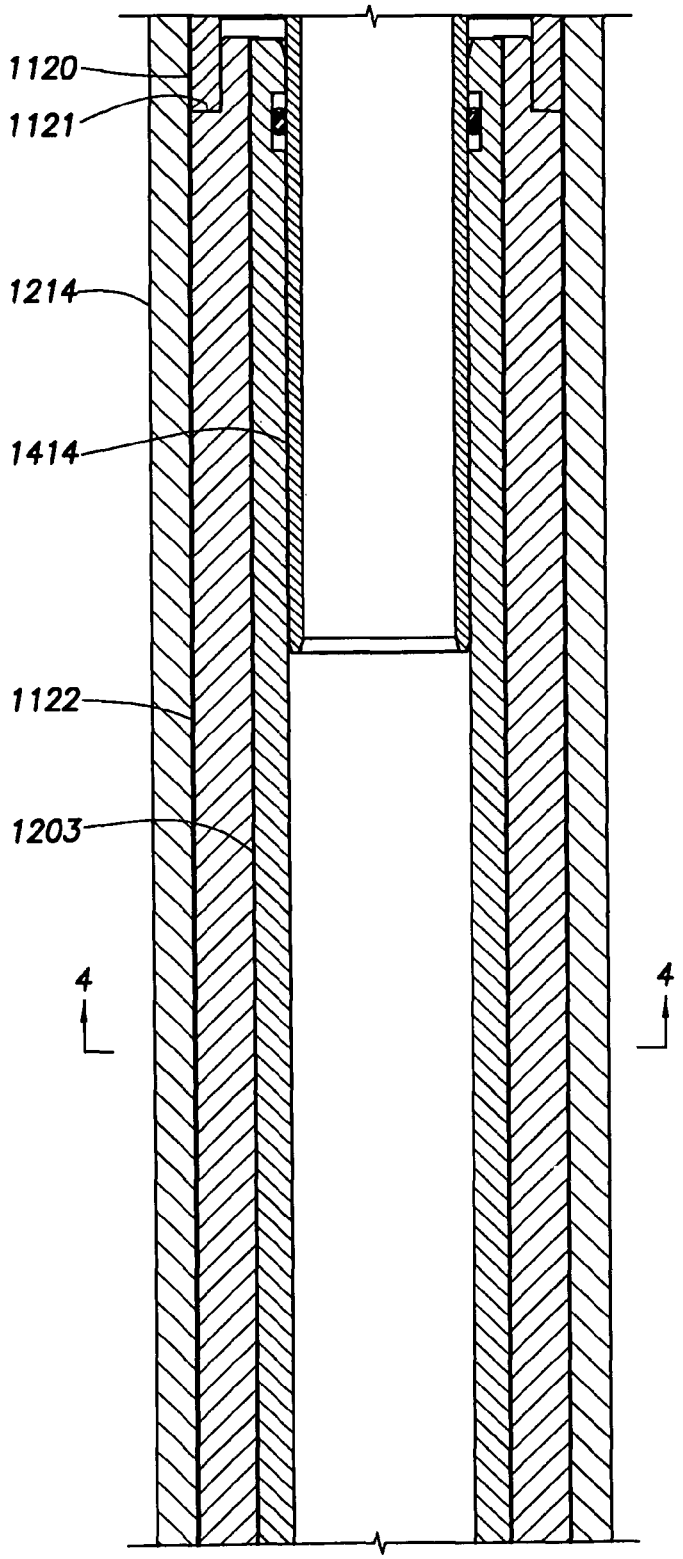
Figure 2M:
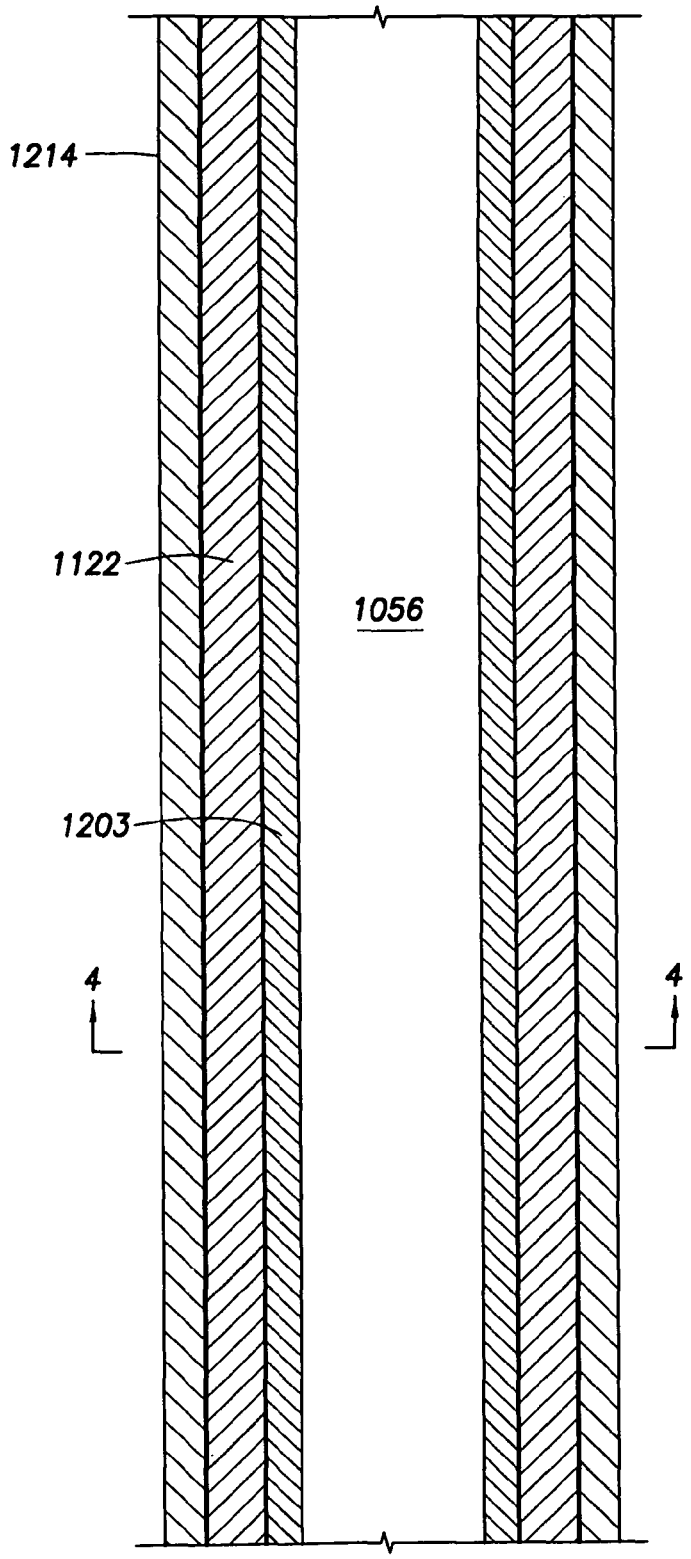
Figure 4:
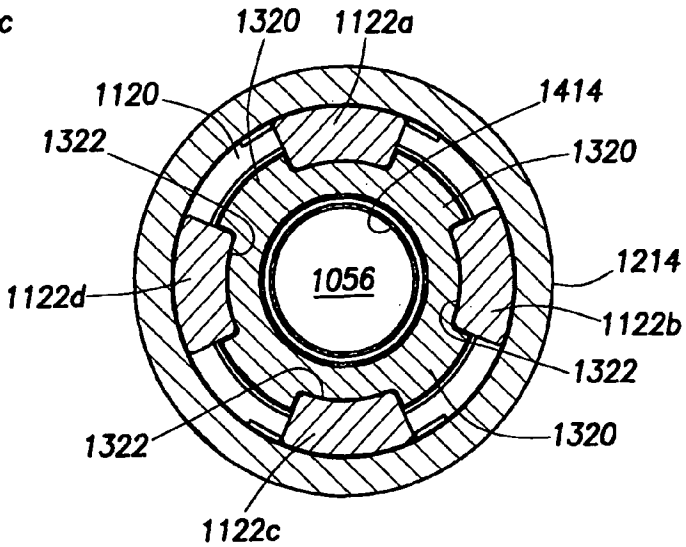
FIG. 4 is a cross-sectional view taken along line 4-4 of FIG. 2 looking upward.

FIG. 4 is a cross-sectional view of the tool assembly taken along line 4-4 of FIG. 2L, looking upward. Like numbers refer to like parts and will not all be addressed here. Of note, the fingers 1122 are seen cooperating with corresponding splines 1320 and grooves 1322 of mandrel guide 1203.

Figure 2N:
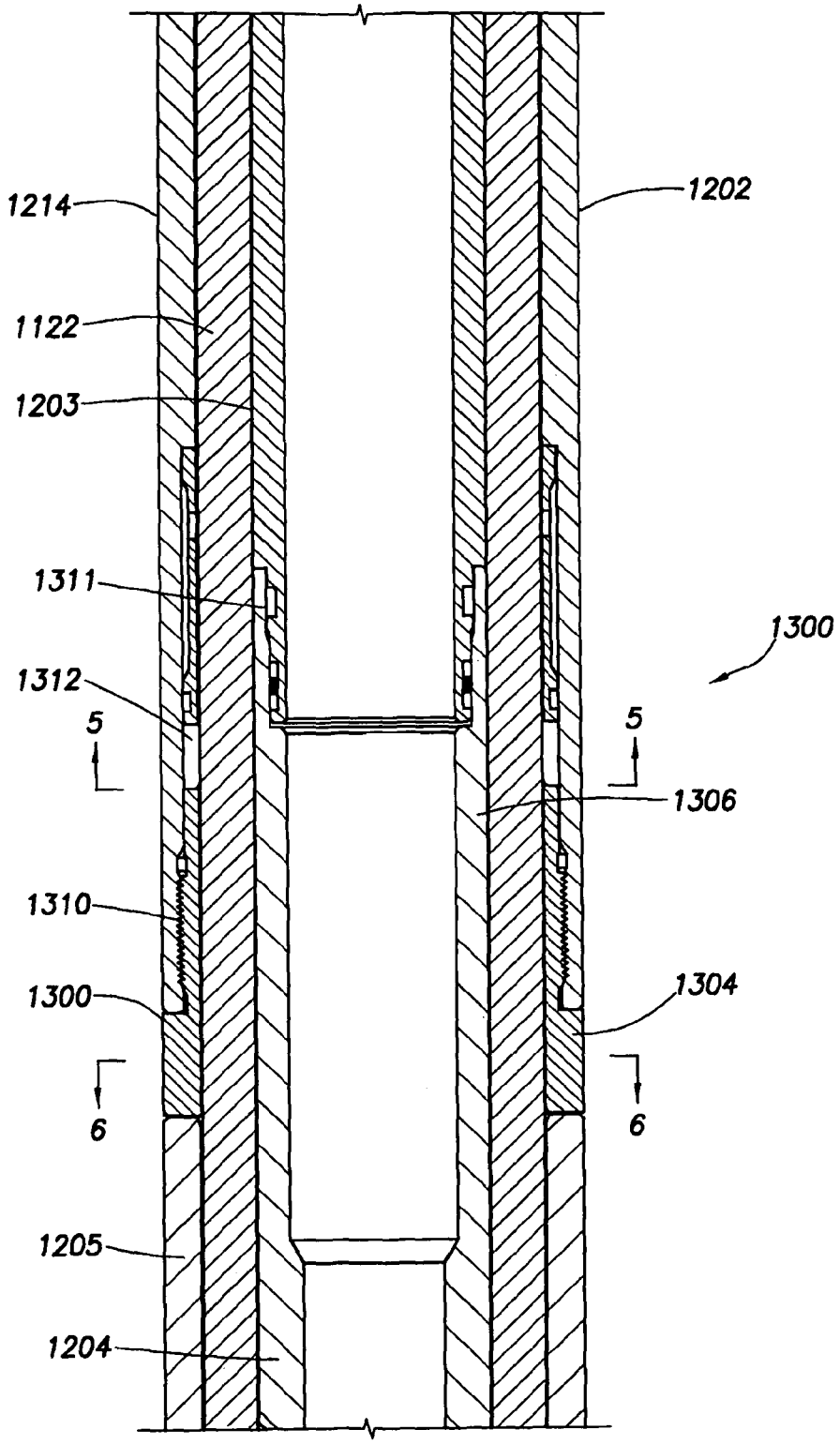
Figure 20:
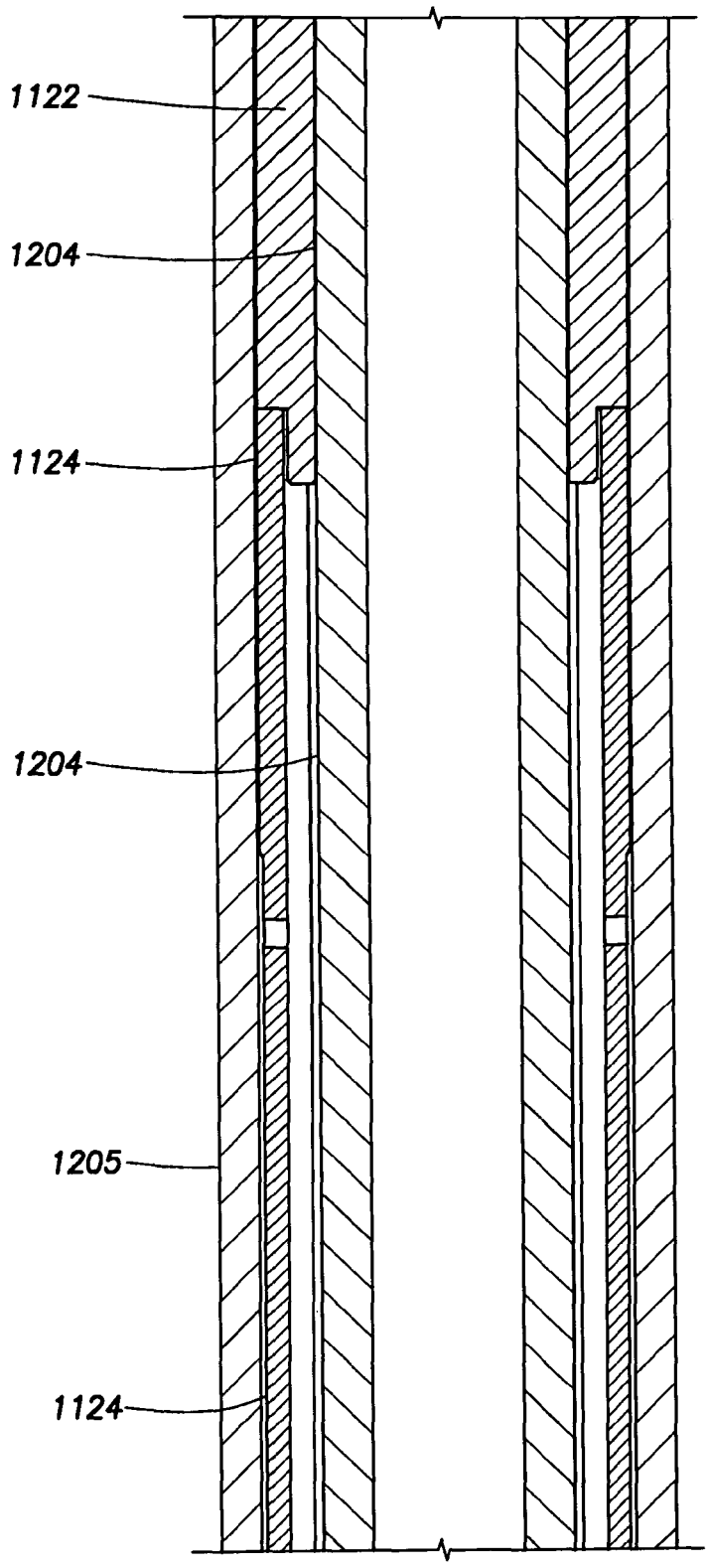
Figure 5:
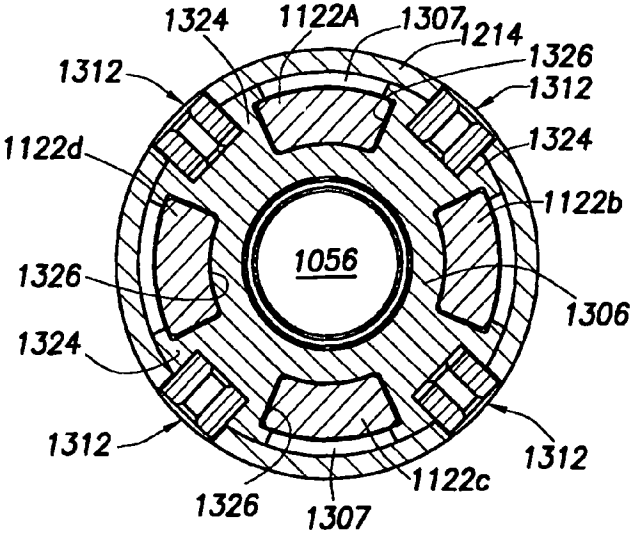
FIG. 5 is a cross-sectional view taken along line 5-5 of FIG. 2 looking upward.

FIG. 5 is a cross-sectional view of the tool assembly taken along line 5-5 of FIG. 2N, looking upward. Like numbers refer to like parts and will not all be addressed here. Of note, the fingers 1122 are seen cooperating with corresponding splines 1324 and grooves 1326 of load cross-over joint (cross-over mandrel) 1300. The splines and grooves, note, preferably provide surfaces which cooperate with all four sides of the corresponding finger. However, also note that at this cross-section, the cross-over mandrel 1300 defines an interior annular ring 1306 while defining exterior annular sectional spaces 1307. Pin assemblies are seen at 1312.

Figure 6:
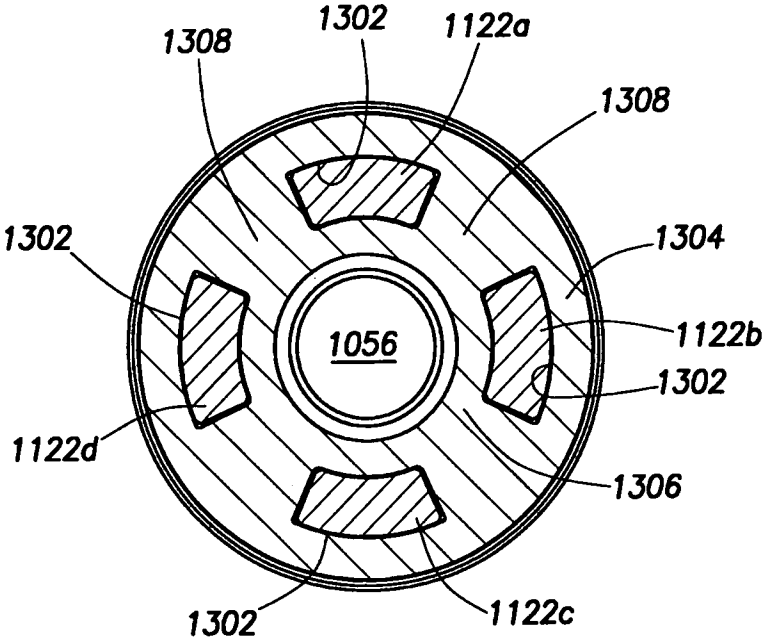
FIG. 6 is a cross-sectional view taken along line 6-6 of FIG. 2 looking downward.

FIG. 6 is a cross-sectional view of the tool assembly taken along line 6-6 of FIG. 2N, looking downward. Like numbers refer to like parts and will not all be addressed here. Of note, the fingers 1122 are seen cooperating with corresponding passages 1302. The cross-over mandrel defines an exterior annular ring 1304, interior annular ring 1308, and radially extending webs 1308 extending between the rings.

Figure 2P:
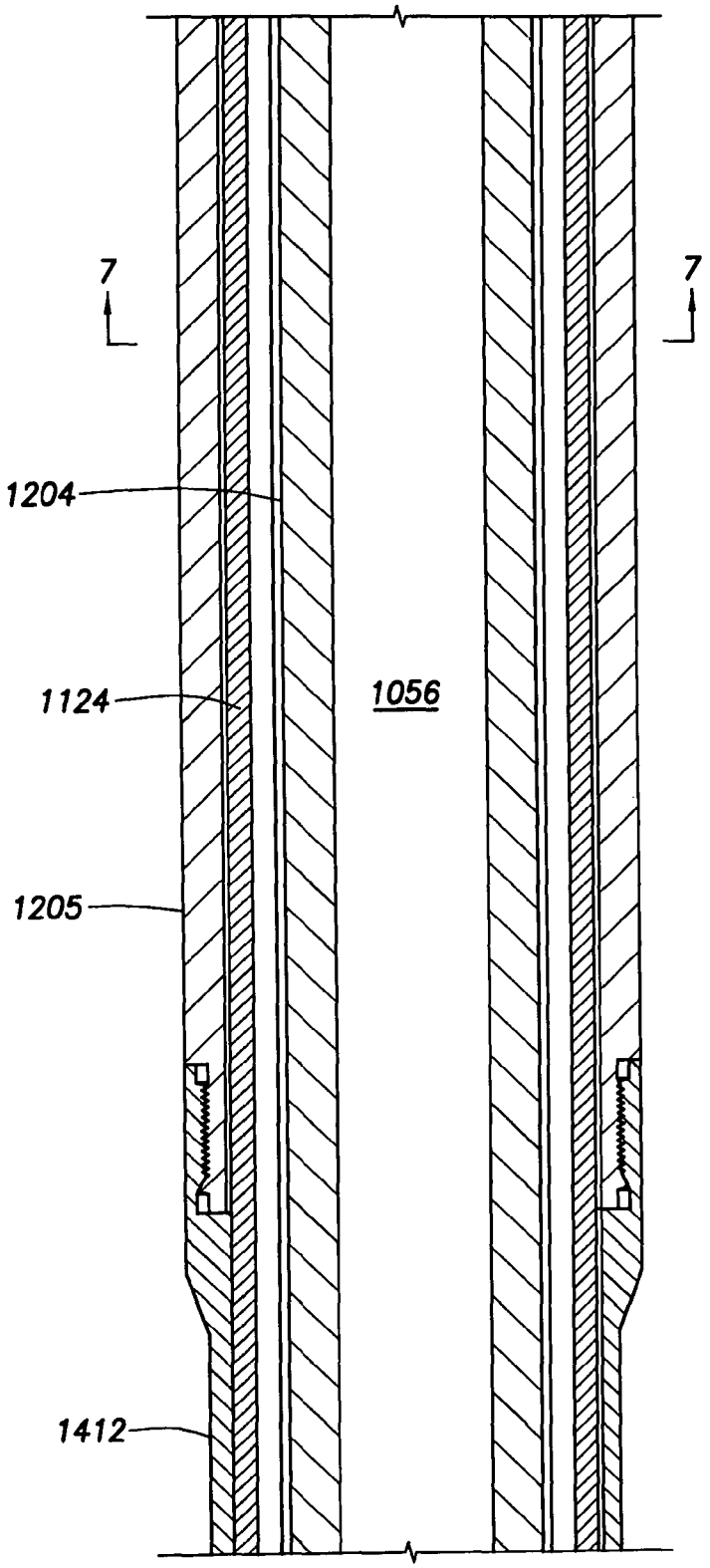
Figure 2Q:
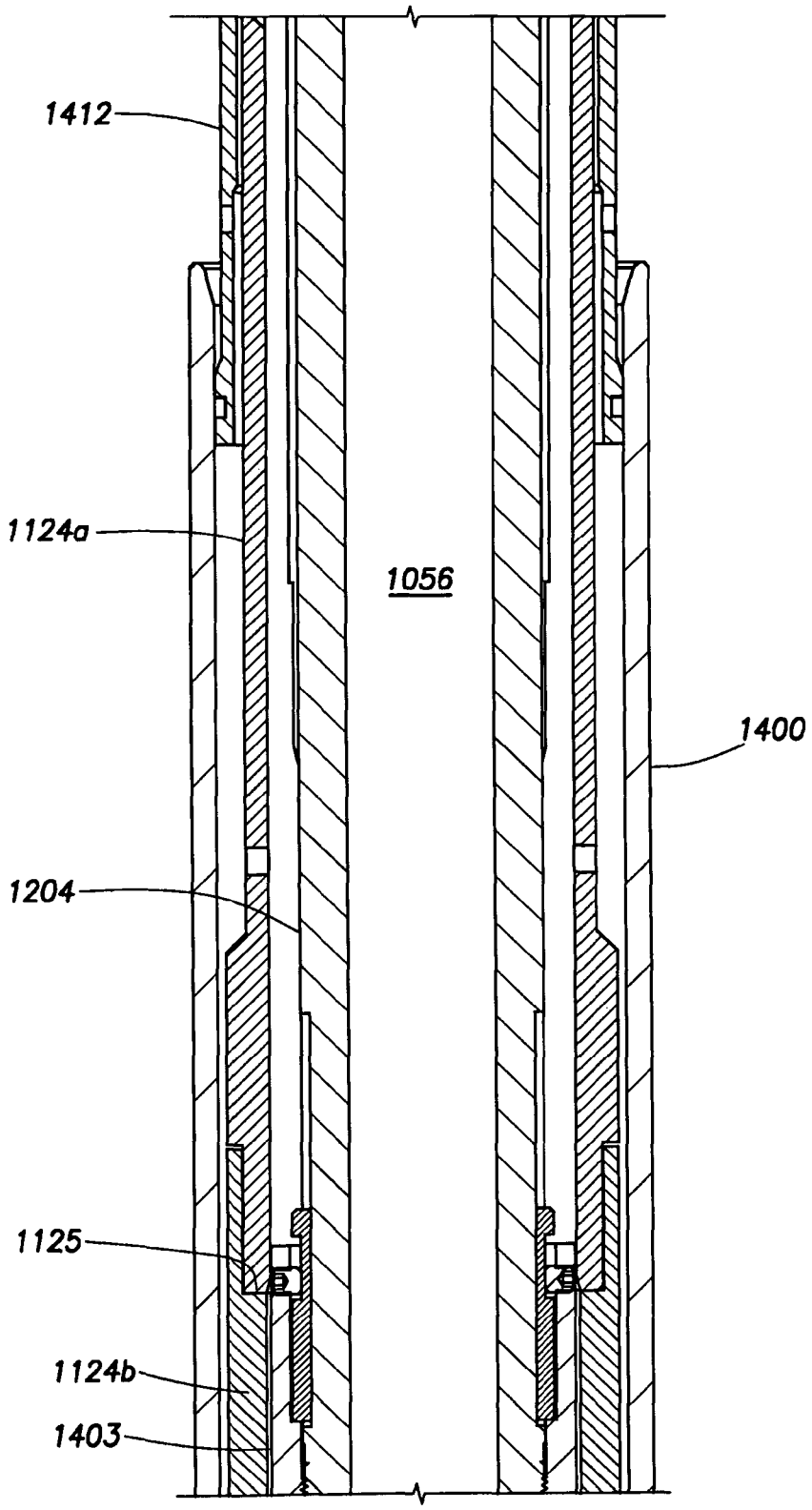
Figure 2R:
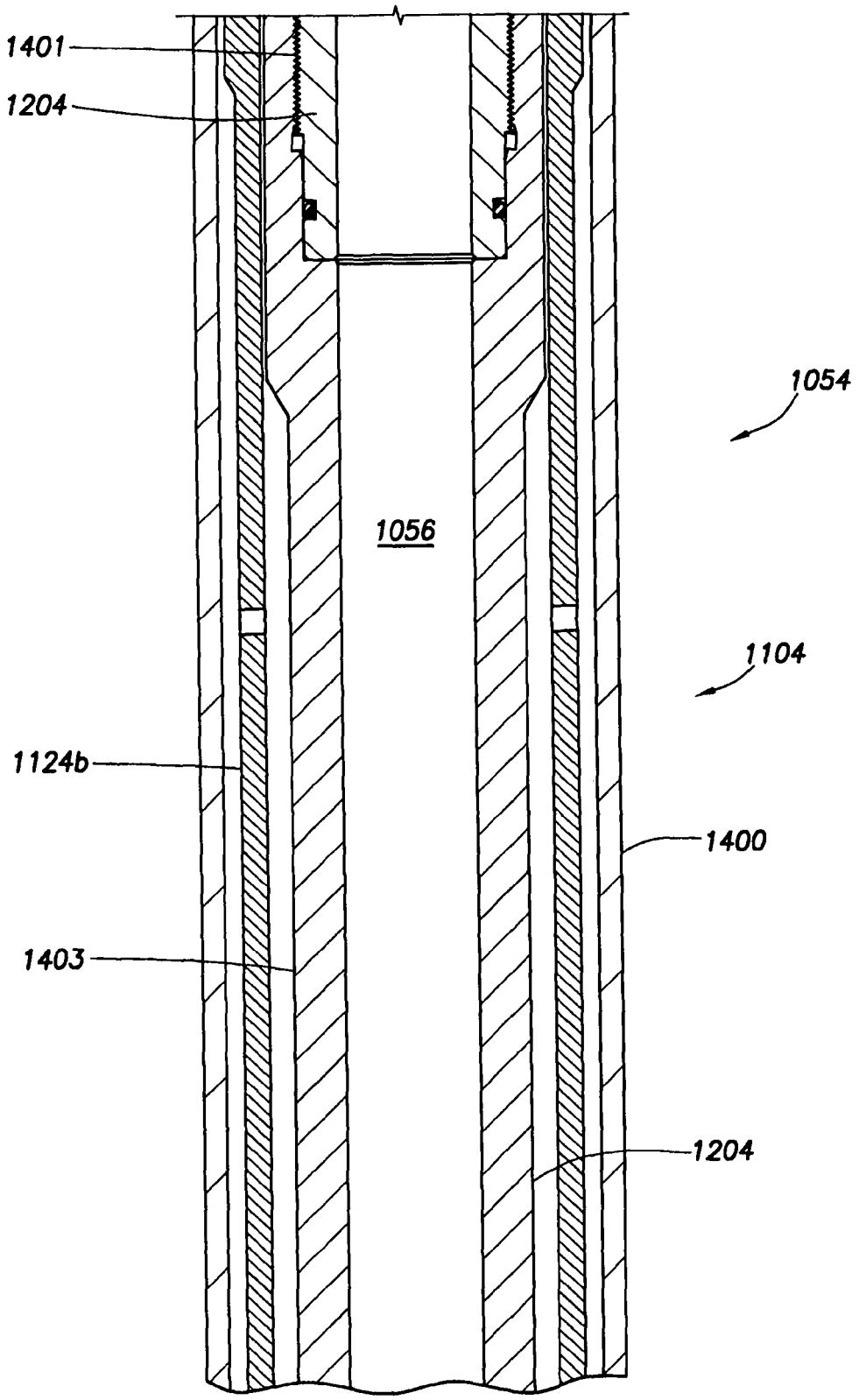
Figure 7:
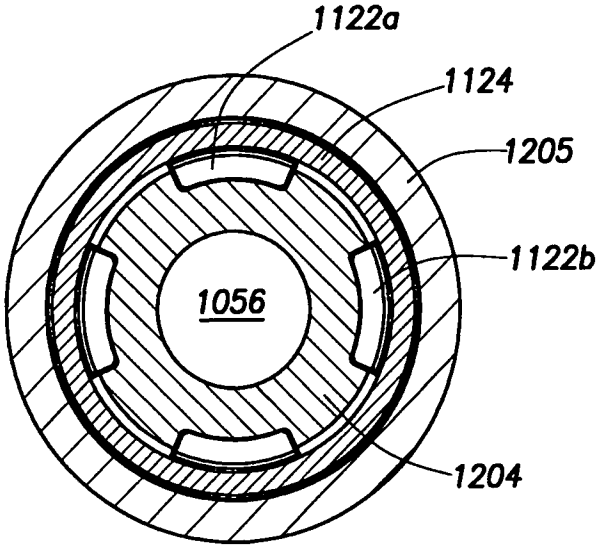
FIG. 7 is a cross-sectional view taken along line 7-7 of FIG. 2 looking upward.

FIG. 7 is a cross-sectional view taken along line 7-7 of FIG. 2P, looking upward. Like numbers refer to like parts and will not all be addressed here. Of note, lower mandrel 1204 is seen in cross-section having cooperating splines 1330 and grooves 1332 corresponding to fingers 1122. The bottom surfaces of the fingers are seen. The cooperating splines, grooves and fingers described herein allow relative longitudinal motion between the parts while providing rotational locking and radial support for the fingers.

After completion of the downhole operation, the running tool assembly is released from the set downhole tool. Several types of disconnection assembly are known in the art, one of which is a collet assembly. A collet sleeve 1403 is seen connected to the lower mandrel 1204 at connection 1401. The collet is disconnected from the liner hanger by placing weight-down on the tool assembly. The collet assembly is not shown in FIG. 2 and not discussed in detail.

Additional tool members can be employed as are known in the art, such as debris sleeve 1412, pass-through sleeve 1414, etc.

For disclosure regarding prior art piston assemblies, specifically force multiplier piston assemblies, see U.S. Patent Application Publication No. 2012/0186829, to Brock, explaining piston multiplier use and optional methods and apparatus for protection of the piston inlet ports, etc., which is incorporated herein by reference for all purposes. Also see U.S. Pat. No. 5,437,330 to Gambertoglio; U.S. Pat. No. 5,553,672 to Smith, Jr., et al.; U.S. Pat. No. 5,170,844 to George, et al.; U.S. Pat. No. 7,562,712 to Cho; and U.S. Patent Application Publication Nos. 2002/0070032 to Maguire; 2009/0107686 to Watson; all of which are incorporated herein by reference for all purposes.

For further disclosure regarding installation of a liner string in a wellbore casing, see U.S. Patent Application Publication No. 2011/0132622, to Moeller, which is incorporated herein by reference for all purposes. For further disclosure regarding cementing procedures and tools, see the other references incorporated herein. For disclosure regarding expansion cone assemblies and their function, see U.S. Pat. No. 7,779,910, to Watson, which is incorporated herein by reference for all purposes. For further disclosure regarding hydraulic set liner hangers, see U.S. Pat. No. 6,318,472, to Rogers, which is incorporated herein by reference for all purposes.

The collet assembly is not described herein in detail since such are known in the art. For further disclosure regarding collets, see U.S. patent application Ser. No. 13/587,596, filed Nov. 1, 2011, to Stautzenberger, incorporated herein by reference for all purposes. Disclosure regarding release collet assemblies can also be found in the other references incorporated herein. Several tools in oil and gas operations include a collet and a collet prop, such as expansion tools and retrieving tools. A collet is generally fitted around the outside of a mandrel. The collet commonly includes at least one concentric ring and collet fingers that extend from the ring. The object the collet attaches and releases from generally includes recesses that correspond to lugs on the collet fingers. The collet fingers are biased to contract around the outer diameter of the mandrel. A collet prop is used to maintain the collet fingers in a desired position until actuation is desired. Another example of a tool that can include a collet is an expansion tool. Prior to expansion, a tubing string, such as a liner, can be suspended from the collet via collet finger lugs that engage recesses in the tubing string. The collet fingers are rigid and can support the weight of the tubing string only when the collet prop is located under the collet. These tools often include an outer cylinder and an inner mandrel. Typically, the outer cylinder and inner mandrel are prevented from moving relative to the tubing string, via a shouldered connection. Once the desired tool operation is completed, such as expansion of the tubing string, the shouldered connection is separated and there is free movement of the outer cylinder or inner mandrel with respect to the tubing string. Upon separation of the shouldered connection, the collet prop can be moved, also called dropped. Typically, this is accomplished by moving either the inner mandrel or the outer cylinder downward with respect to the tubing string. The movement of the outer cylinder or inner mandrel causes the collet prop to move out from underneath the collet. The collet prop is dropped below the collet so the collet fingers are allowed to flex toward the lower mandrel. The tool and running tool string are disconnected, and the string pulled out of hole.

Exemplary methods of use of the invention are described, with the understanding that the invention is determined and limited only by the claims. Those of skill in the art will recognize additional steps, different order of steps, and that not all steps need be performed to practice the inventive methods described.

In preferred embodiments, the following methods are disclosed; the steps are not exclusive and can be combined in various ways. A method for performing an oilfield operation in a subterranean wellbore extending through a hydrocarbon-bearing zone, the method comprising the steps of: positioning a downhole tool assembly on a work string, the downhole tool assembly having a mandrel assembly for bearing the tensile and rotational load on the assembly, and a displacement assembly for movement in relation to the mandrel assembly; bearing the tensile and rotational load on the downhole tool assembly along a load path positioned radially outward from an upper portion of the displacement assembly; bearing the tensile and torsional load on the downhole tool assembly along a load path positioned radially inward from a lower portion of the displacement assembly; and moving the displacement assembly in relation to the mandrel assembly. The method can further comprise the steps of: bearing the tensile and torsional load on the tool assembly along a load path that radially crosses the displacement assembly; longitudinally moving a portion of the displacement assembly through cooperating passages in the mandrel assembly; moving a plurality of displacement load transfer rods longitudinally through a corresponding plurality of passages through a radially extending portion of the mandrel assembly.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention, will be apparent to person skilled in the art upon reference to the description. It is, therefore, intended that the appended claims encompass any such modifications or embodiments.

It is claimed:

1. A downhole tool assembly for use in a wellbore, the assembly comprising:

a mandrel assembly for bearing the tensile and rotational loads placed on the tool assembly during run-in to the wellbore; and a displacement assembly for substantially bearing displacement loads and for providing relative movement to the mandrel assembly, the displacement assembly for actuating a actuatable tool attached to the mandrel assembly;

wherein the mandrel assembly has an upper mandrel positioned radially outward of the displacement assembly, a lower mandrel positioned radially inward of the displacement assembly, and a load cross-over mandrel interconnected between the upper and lower mandrels and operable to transfer tensile and rotational load between the upper and lower mandrels; and wherein the displacement assembly has an upper displacement assembly positioned longitudinally upward of the load cross-over mandrel, a lower displacement assembly positioned longitudinally downward of the load cross-over mandrel, and a pass-through displacement assembly positioned between, and operable to transfer the displacement loads between, the upper and lower displacement assemblies.

2. The downhole tool assembly as in claim 1, wherein the load cross-over mandrel includes a plurality of passageways extending longitudinally therethrough, and wherein the pass-through displacement assembly includes a corresponding plurality of displacement load transfer members extending through the corresponding plurality of passageways.

3. The downhole tool assembly as in claim 2, wherein the plurality of displacement load transfer members are longitudinally extending rods.

4. The downhole tool assembly as in claim 1, wherein the upper and lower displacement assemblies are sleeves.

5. The downhole tool assembly as in claim 1, wherein the upper, lower and pass-through displacement assemblies are of a substantially uniform outer diameter.

6. The downhole assembly of claim 1, wherein the downhole tool assembly is capable of being assembled on a rig floor.

7. The downhole tool assembly of claim 6, wherein the upper displacement assembly includes a tool joint.

8. The downhole tool assembly of claim 7, wherein assembly of the tool assembly does not require a pressure test.

9. The downhole tool assembly of claim 7, wherein at least one piston assembly is positioned above the tool joint and wherein at least one piston assembly is positioned below the tool joint, the piston assemblies operable to move the displacement assembly in relation to the mandrel assembly.

10. A downhole tool assembly for use in a wellbore, the assembly comprising:

a mandrel assembly for substantially bearing the tensile and rotational loads placed on the tool assembly during run-in to the wellbore; and a displacement assembly for substantially bearing displacement loads and for providing relative movement to the mandrel assembly, the displacement assembly for actuating a actuatable tool attached to the mandrel assembly;

wherein the mandrel assembly has an upper mandrel positioned radially outward of the displacement assembly, a lower mandrel positioned radially inward of the displacement assembly, and a load cross-over mandrel interconnected between the upper and lower mandrels and operable to transfer tensile and rotational load between the upper and lower mandrels; and wherein the displacement assembly includes at least one piston assembly, the piston assembly operable to move the displacement assembly in relation to the mandrel assembly.

11. The downhole tool assembly as in claim 10, wherein the piston assembly is operable in response to a change in a wellbore fluid.

12. A downhole tool assembly for use in a wellbore, the assembly comprising:

a mandrel assembly for substantially bearing the tensile and rotational loads placed on the tool assembly during run-in to the wellbore; and a displacement assembly for substantially bearing displacement loads and for providing relative movement to the mandrel assembly, the displacement assembly for actuating a actuatable tool attached to the mandrel assembly;

wherein the mandrel assembly has an upper mandrel positioned radially outward of the displacement assembly, a lower mandrel positioned radially inward of the displacement assembly, and a load cross-over mandrel interconnected between the upper and lower mandrels and operable to transfer tensile and rotational load between the upper and lower mandrels; and wherein the displacement assembly includes at least one piston assembly having a piston rod and a piston, the at least one piston assembly operable in response to increased wellbore fluid pressure.

13. The downhole tool assembly as in claim 12, wherein the mandrel assembly and displacement assembly define a tool bore extending longitudinally therethrough and operable to convey changes in wellbore fluid from the surface to a location downhole.

14. A downhole tool assembly for use in a wellbore, the assembly comprising:

a mandrel assembly for substantially bearing the tensile and rotational loads placed on the tool assembly during run-in to the wellbore; and a displacement assembly for substantially bearing displacement loads and for providing relative movement to the mandrel assembly, the displacement assembly for actuating a actuatable tool attached to the mandrel assembly;

wherein the mandrel assembly has an upper mandrel positioned radially outward of the displacement assembly, a lower mandrel positioned radially inward of the displacement assembly, and a load cross-over mandrel interconnected between the upper and lower mandrels and operable to transfer tensile and rotational load between the upper and lower mandrels; and wherein the load cross-over mandrel defines an inner annular ring, an outer annular ring, and a plurality of longitudinal passageways extending through the load cross-over mandrel for cooperating with corresponding displacement assembly load transfer members.

15. A method of performing an oilfield operation in a subterranean wellbore extending through a hydrocarbon-bearing zone, the method comprising the steps of:

positioning a downhole tool assembly on a work string, the downhole tool assembly having a mandrel assembly for bearing the tensile and rotational load on the assembly, and a displacement assembly for movement in relation to the mandrel assembly;

bearing the tensile and rotational load on the downhole tool assembly along a load path positioned radially outward from an upper portion of the displacement assembly;

bearing the tensile and torsional load on the downhole tool assembly along a load path positioned radially inward from a lower portion of the displacement assembly;

moving the displacement assembly in relation to the mandrel assembly; and moving a plurality of displacement load transfer rods longitudinally through a corresponding plurality of passages, the passages being formed through a radially extending portion of the mandrel assembly.

16. The method as in claim 15, further comprising the step of bearing the tensile and torsional load on the tool assembly along a load path that radially crosses the displacement assembly.

17. The method as in claim 16, further comprising the step of longitudinally moving a portion of the displacement assembly through cooperating passages in the mandrel assembly.

* * * * *